US005131491A

United States Patent [19]

Varner et al.

[11] Patent Number: 5,131,491

[45] Date of Patent: Jul. 21, 1992

[54] DESCENT CONTROLLER

[75] Inventors: Horace M. Varner; Ernest L. Stech; Richard H. Frost, all of Littleton, Colo.

[73] Assignee: Frost Engineering Development Corp., Englewood, Colo.

[21] Appl. No.: 652,130

[22] Filed: Feb. 7, 1991

Related U.S. Application Data

[63] Continuation-in-part of Ser. No. 554,687, Jul. 18, 1990, Pat. No. 5,038,888.

[51] Int. Cl.[5] ..... A62B 1/14; B65H 59/14

[52] U.S. Cl. ..... 182/7; 188/65.2; 188/65.5

[58] Field of Search ..... 182/5-9; 188/65.2-65.5

[56] References Cited

U.S. PATENT DOCUMENTS 4,102,431 7/1978 Carroll ..... 182/5

5,038,888 8/1991 Varner et al. ..... 182/5

*Primary Examiner*—Reinaldo P. Machado

*Attorney, Agent, or Firm*—Ralph F. Crandell

[57] ABSTRACT

A descent controller (30) for lowering a load along a rope (32). Controller is a friction cylinder or capstan (31) of a length adapted to receive a plurality of turns of rope (32) between top and bottom end plates (34, 35) adjacent the upper and lower ends of said cylinder which overhang the cylinder (31) and define radial slots (40, 41) sized to loosely receive the rope. An upwardly narrowing tapered slot (44) defined diametrically through the capstan (31) receives and releasably grips the rope. An annular clamp ring (48) is slidably mounted on the cylinder (31) and defines a radial aperture (49) which loosely receives the rope as it exits from the tapered slot (44). A spring (41) biases the ring (48) upwardly along the said friction cylinder (31) for releasably wedging the rope (32) in the tapered slot. A gripping cylinder (55) is secured to the ring for sliding the ring (48) along the friction cylinder (31) to release the rope (32) from the narrow end (46) of the tapered slot (44), and defines a housing enclosing the capstan and rope turns.

54 Claims, 14 Drawing Sheets

Fig_39
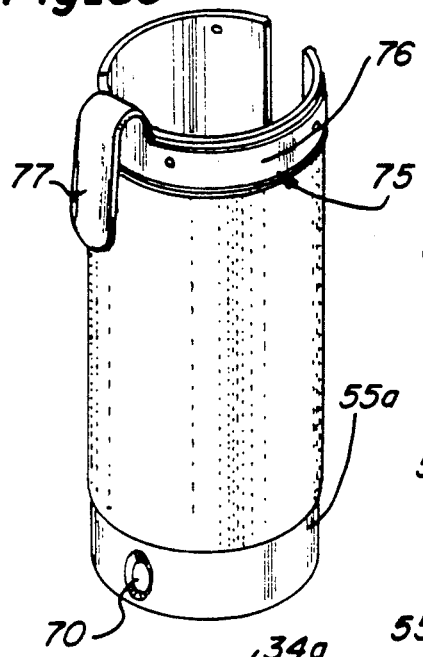
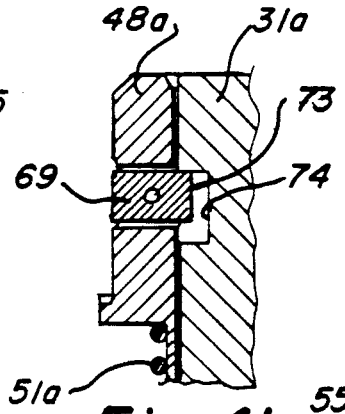
Fig_41
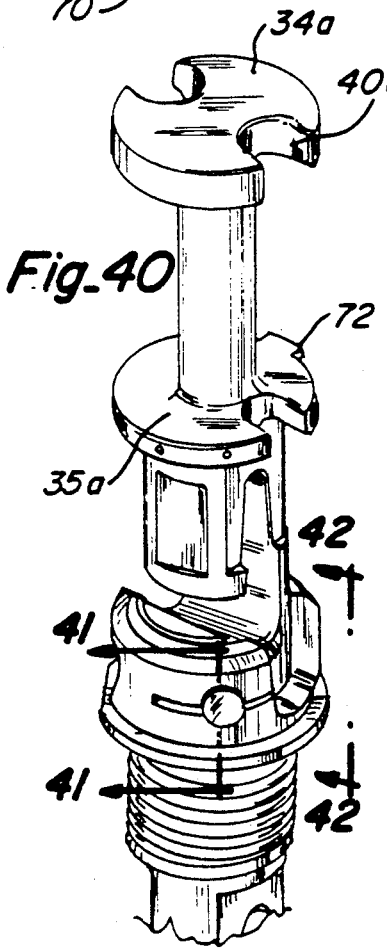
Fig_40
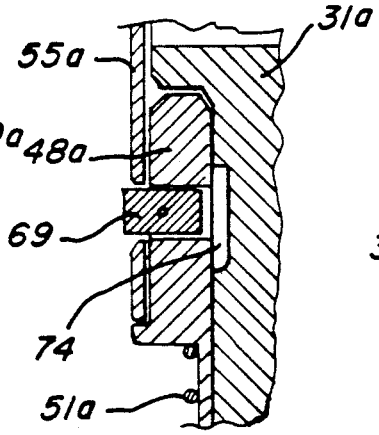
Fig_38
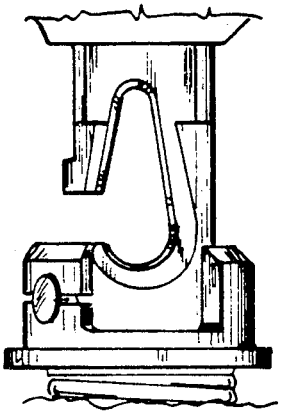
Fig_42
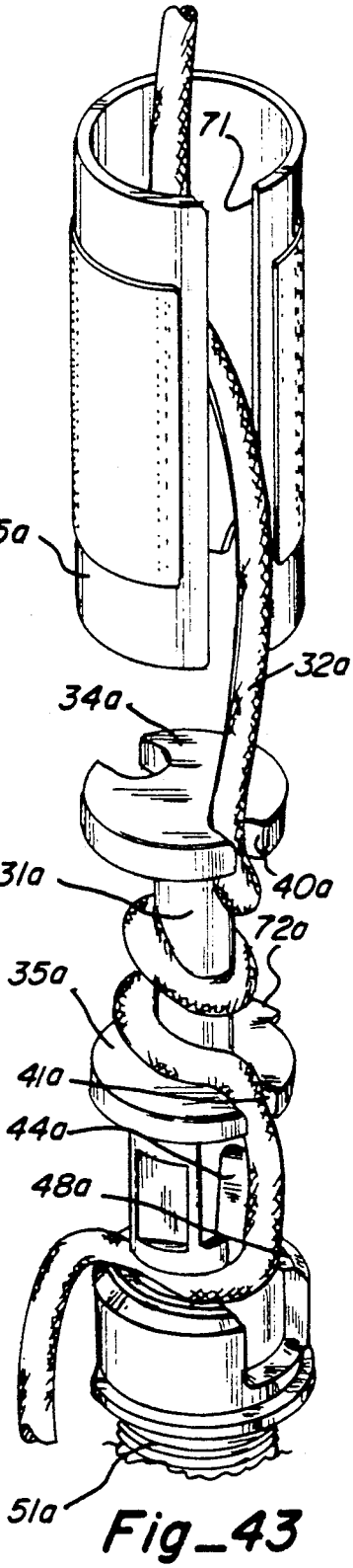
Fig_43

DESCENT CONTROLLER

CROSS-REFERENCE TO RELATED APPLICATION

This application is a continuation-in-part of copending application Ser. No. 07/554,687, filed July 18, 1990 for DESCENT CONTROLLER, now U.S. Pat. No. 5,038,888, issued Aug. 13, 1991.

BACKGROUND OF THE INVENTION

1. Field Of The Invention

The present invention relates to a descent controller for use on a rope or cable for lowering a person or load in a controlled descent from a higher elevation to a lower elevation, and more particularly to a rope or cable mounted descent control device having a control member including both a deadman brake and a panic brake.

2. Description Of The Prior Art

Descent control devices have been developed, all with the objective of lowering a load from a higher to a lower elevation. These devices have taken many forms and have utilized a variety of elements capable of providing a mechanical advantage together with a braking mechanism. Safety features, such as deadman and panic control features, are equally important, particularly when the device is used for descent, escape, or rescue purposes.

In more recent years, concerns with occupational safety have led to the development of mechanisms which enable a worker to lower himself from an elevated position such as a scaffold, crane, lift truck or platform in the event of an emergency. The equipment is, in many respects, similar to known fire escape devices, mountain climbing equipment, and military equipment.

A descent control device with a deadman brake, in the form of a vertical cylindrical drum or capstan about which a rope is wound and a tapered slot through the drum for receiving and releasably gripping the rope along which descent is made, together with a releasable locking end plate, is shown in U.S. Pat. No. 4,883,146, issued Nov. 28, 1989, to H. M. Varner and E. L. Stech for "DESCENT CONTROL DEVICE WITH DEADMAN BRAKE." The device shown in the patent to Varner et al. includes end plates on each end of a vertical cylindrical drum or capstan with apertures on each end plate through which a rope is threaded. The rope is wound in two or more turns around the drum. The lower plate is provided with an arcuate tapered slot opening into the rope receiving aperture for engaging and binding the rope in order to provide a brake. The rope is mechanically forced into the aperture by a locking end plate rotatably mounted on the capstan below the lower end plate. The locking plate includes an aperture for loosely receiving the rope. A spring rotatably biases the locking plate to releasably and forcibly urge the rope into the narrowed tapered slot in the lower end plate for locking the rope against movement on the capstan. By rotating the locking plate against the force of the spring the rope can be progressively released from the tapered slot.

Tapered slots are ancient and well known in the art of releasably fastening ropes, lines and cables, such as in the nautical field where tapered slots are widely used for engaging and retaining ropes, lines, hawsers and cables. The use of cylindrical capstans for holding and providing a mechanical advantage for tightening ropes is also old and well known. Likewise, a variety of fire escape devices utilizing a rope wound around a cylinder, are old and well known. See, for example, U.S. Pat. No 4,550,801, issued Nov. 5, 1985, to W. E. Forrest for "PERSONAL HIGH RISE EVACUATION APPARATUS"; U.S. Pat. No. 4,311,218, issued Jan. 9, 1982, to L. Steffen for "BRAKING-DEVICE FOR USE WITH CLIMBING LINES"; U.S. Pat. No. 771,251, issued Oct. 4, 1904, to O. Howe for "FIRE ESCAPE"; U.S. Pat. No. 386,237, issued July 17, 1888, to T. Budd for "FIRE ESCAPE"; U.S. Pat. No. 1,115,603, issued Nov. 3, 1914, to J. Smith for "FIRE ESCAPE"; U.S. Pat. No. 536,866, issued Apr. 2, 1895, to C. FitzGerald for "FIRE ESCAPE"; and U.S. Pat. No. 946,588, issued Jan. 18, 1910, to C. Thuemer for "FIRE ESCAPE."

OBJECTS AND SUMMARY OF THE INVENTION

It is the principal object of the present invention to provide an improved load lowering descent controller of the type embodying a cylindrical body or capstan about which a rope or cable is turned. A related object is to provide a device of the foregoing character which is a fail-safe type descent device. A further related object is to provide such a device capable of retarding descent of the device in the event of a panic actuation of the controller.

Another object of the present invention is to provide a descent controller of the foregoing character which may be actuated for lowering a load such as an unconscious user or equipment.

A further object of the present invention is to provide a descent controller of the foregoing character which incorporates energy absorbing characteristics to provide for shock loading when in the locked position and to provide for a controlled descent after absorption of the shock.

Still another object of the present invention is to provide a descent controller of the foregoing characteristics which may be attached to or removed from a rope at any point along its length.

A further object of the present invention is to provide a descent controller having the foregoing characteristics which enables the user to adjust the mechanical advantage of the device independently of the position of the device on the rope.

In accordance with the foregoing objects, the present invention is embodied in an improved descent controller for lowering a load along a rope from an elevated position to a relatively lower position. The controller comprises a friction cylinder or capstan of a length adapted to receive a plurality of turns of the rope wrapped therearound. The cylinder or capstan has an upper end and a lower end, with top and bottom end plates attached respectively adjacent the upper end and spaced from the lower end of said cylinder. The end plates both have a portion thereof overhanging the cylinder and defining radial slots sized to loosely receive the rope. A portion of the friction cylinder extends below said lower end plate and defines diametrically therethrough an upwardly narrowing tapered slot adapted to receive the rope. The tapered slot defines an enlarged end adapted to freely admit the rope and tapering from said enlarged entry to a relatively constricted end of a width sufficient for gripping the rope. An annular control ring is slidably mounted on said cylinder below the bottom end plate and defines radially therethrough an aperture adapted to loosely receive said rope as it exits from said tapered slot. A spring biases said ring upwardly along said friction cylinder for wedging said rope in the narrow end of said tapered slot. An outer sleeve is secured to the ring for use in sliding said ring along the friction cylinder against the force of the biasing spring to release the rope from the narrow end of the tapered slot. The sleeve defines a housing enclosing the friction cylinder and the rope wrapped therearound. Means are provided on the lower end of the friction cylinder below the tapered slot for engagement with a load support. The descent controller supports a load on the rope and, upon sliding movement of the sleeve, provides for a controlled descent of the supported load along the rope.

The descent controller further includes a gripping sleeve secured to the control ring for use in sliding said control ring along said friction cylinder. The gripping sleeve defines a housing enclosing the friction cylinder and the rope wrapped therearound. It is releasably secured to the control ring, and may also include a longitudinally extending slot therein of a width for receiving said rope. In the latter event, the friction cylinder defines a radial slot opening into the tapered slot and sized to loosely receive said rope, so that the rope may be wound on or removed from the capstan. The control ring also defines an axially extending slot opening into the radial aperture and sized to loosely receive said rope, so that the rope can be released from or inserted into said aperture.

The invention further includes modifications and applications which enhances its utility. One modified form utilizes a rack or ladder capstan arrangement with a plurality of co-planar rollers or cross bars about which the rope is woven or entrained. The controller itself may be secured at an elevated position and actuated at that point to lower a rope-supported load. A second or reserve rope may be used.

The invention also contemplates an emergency descent kit or package which may be held in reserve and used when needed. Such a kit, stored in a bag or package, includes, in addition to the descent controller, a descent rope and harness. The rope includes a loop or hook fastening device at one end adapted to be secured to a fixed object at the elevated position. After fixing the rope to a support, the user drops the case and rope supply to the ground. The user then sits in the harness and using the descent controller, lowers himself to safety.

DESCRIPTION OF THE DRAWINGS

FIG. 38 is an enlarged section view taken substantially in the plane of line 38—38 on FIG. 24.

FIG. 39 is a perspective view of the outer gripping sleeve of the descent controller shown in FIG. 24 but with a belt hook added thereto.

FIG. 40 is a perspective view of the internal capstan, clamping ring, and spring forming a part of the descent controller shown in FIG. 24.

FIG. 41 is a partial section view taken substantially in the plane of line 41—41 on FIG. 40.

FIG. 42 is a section view taken substantially in the plane of line 42—42 on FIG. 40.

FIG. 43 is an exploded view of a portion of the descent controller shown in FIG. 24 illustrating the controller in association with a portion of rope.

DESCRIPTION OF THE PREFERRED EMBODIMENTS

The descent controller 30 embodying the present invention is shown in its basic form in FIGS. 1-19, and comprises by a vertically oriented capstan 31 such as a cylinder shaft or drum about which a length of rope or line 32 is wound. The number of turns of rope is the principal determinate of the capstan ratio or force reduction. The rope 32 is secured at one end at an elevated point (not shown) above the ground, and hangs downwardly to the ground or a lower platform (not shown). The descent controller 30 is mounted on the rope to enable the user or a load to descend slowly and controllably along the rope from the elevated point to the lower point, whether the ground or a platform. The descent controller is characterized as a capstan type, in which the rope is wound in a number of turns around a capstan 31, thereby providing a mechanical advantage enabling the user or load to descend slowly along the rope as the rope hangs from the elevated point. The controller 30 includes means for selecting gripping the rope and preventing descent or releasing the rope to provide for the controlled descent. In one extreme position or deadman position, the controller grips the rope tightly and prevents descent. In the opposite or panic position, the controller temporarily engages and grips the rope to prevent or substantially retard the descent. For example, in the case of a user who believes the descent is too fast and panics by grabbing onto the controller and jamming it downwardly, descent will stop or slow as a result of friction engagement between the controller and the rope. In the normal descent position once the rope is released the rate of descent is determined by the number of turns of rope wrapped around the capstan or friction cylinder as the controller slides down the rope.

A modified and highly useful form of the present invention is shown in FIGS. 24-43. This construction allows the descent controller to be mounted on or removed from the rope at any point between its ends, and similarly allows for adjustment in the number of turns of the rope about the capstan, thereby providing for adjustment of the performance. It must be understood, however, the once the descent has started the number of turns of the rope about the capstan can not be adjusted. It is therefore desirable to adjust the controller before depending upon it to descend from a higher to a lower elevation.

Figure 20:
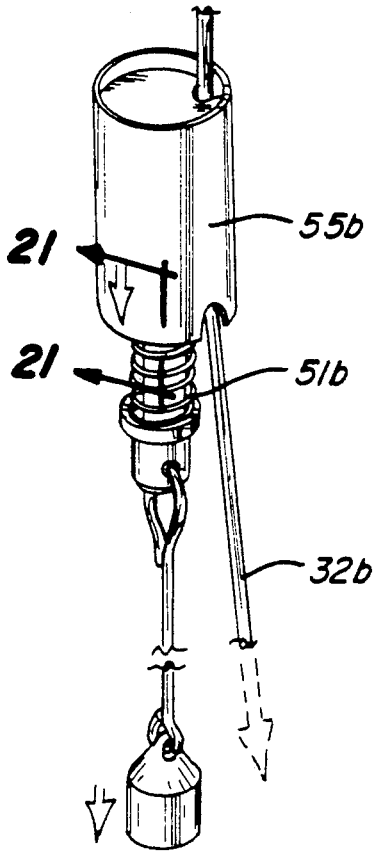
FIG. 20 is a perspective view of a modified form of descent controller embodying the present invention in which the lowering of the load is controlled by pulling on the free end of the descent rope.
Figure 21:
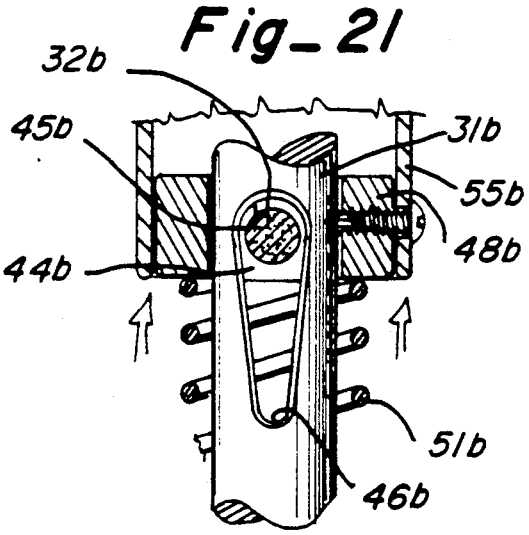
FIG. 21 is an enlarged section view taken substantially in the plane of line 21—21 on FIG. 20.
Figure 23:
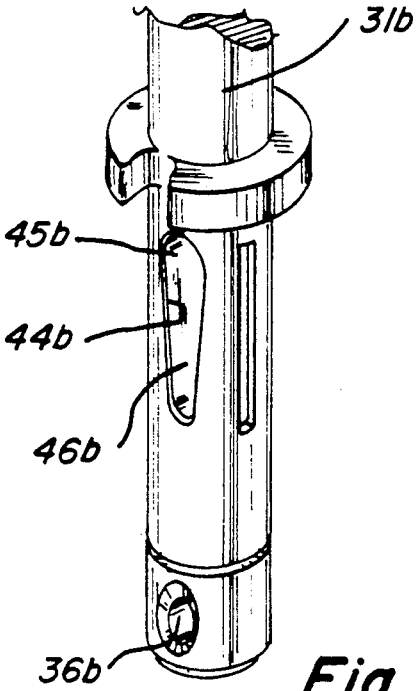
FIG. 23 is an enlarged perspective view of a capstan utilized in the modification of the descent controller shown in FIG. 20.
Figure 22:
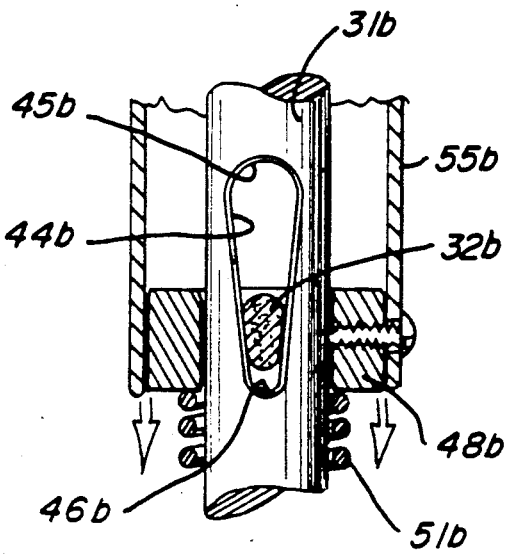
FIG. 22 is a section view similar to FIG. 21 but showing the rope in a locked position

Other modified forms of the invention are shown in the drawings. One modification useful for controlling the descent of a load by pulling or releasing the free end of the rope is shown in FIGS. 20-22. Pulling down on the controller sleeve also retards descent.

Figure 52:
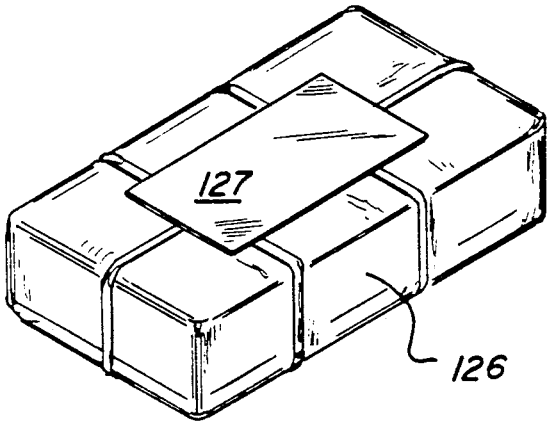
FIG. 52 is a perspective view of an emergency descent kit utilizing a descent controller embodying the present invention.
Figure 53:
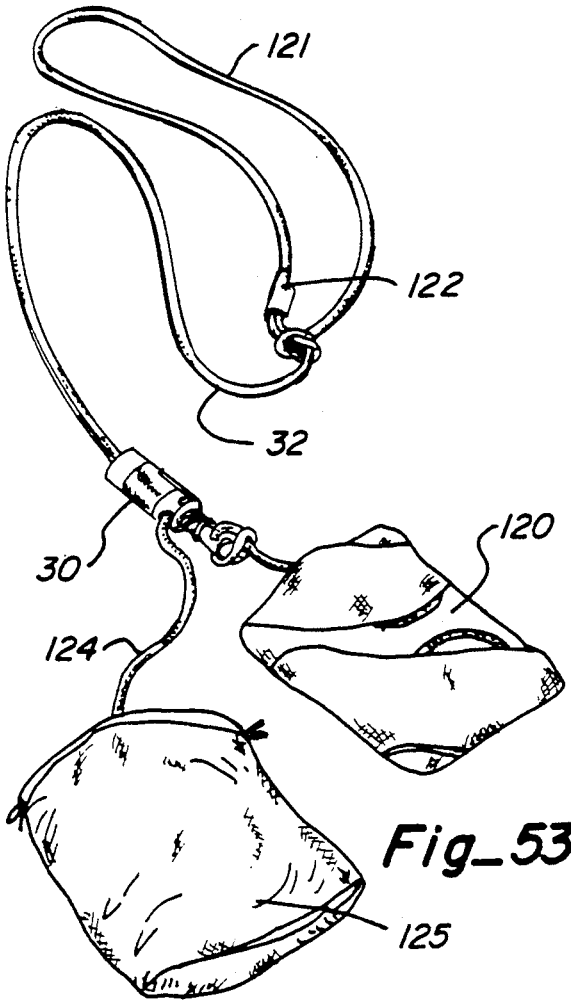
FIG. 53 is a perspective view of a portion of the kit shown in FIG. 52 with portions of the kit open for use and illustrating the rope and descent controller arrangement.
Figure 54:
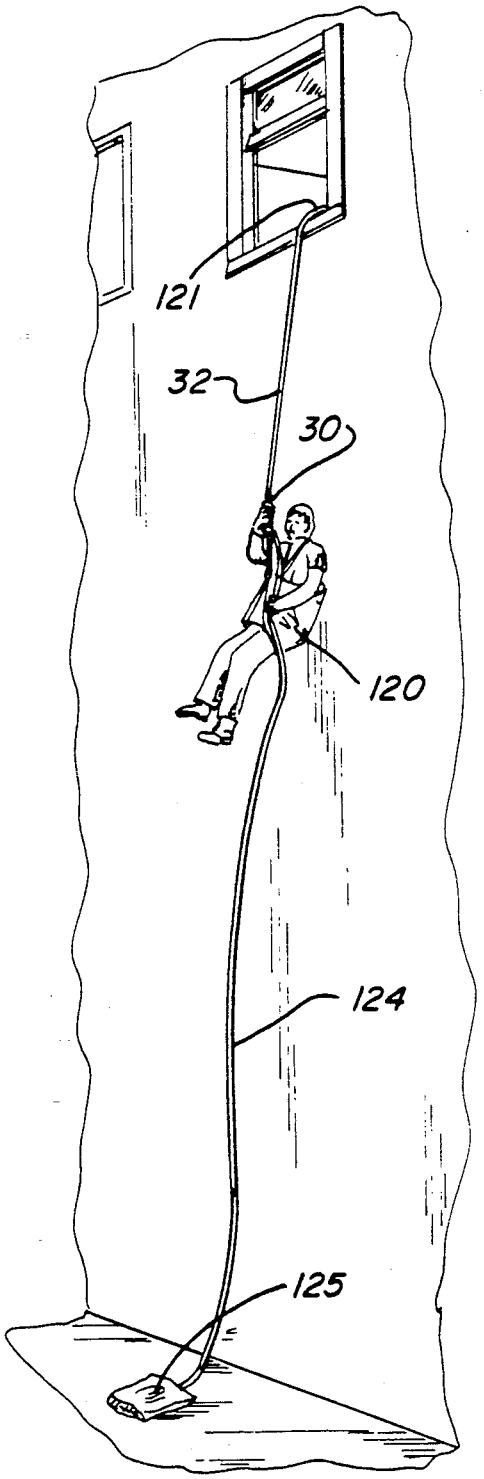
FIG. 54 is a perspective view of a descent assembly embodying the present invention in use for descending from an elevated position to ground level.
Figure 55:
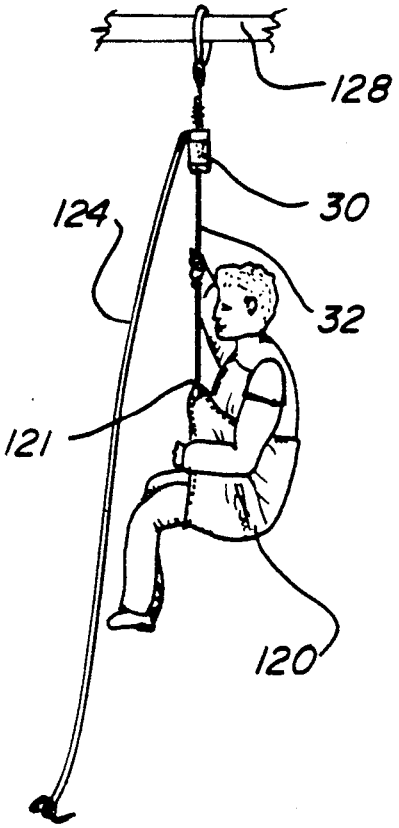
FIG. 55 is a schematic view illustrating use of the descent controller embodying the present invention for lowering a load separate from the person controlling the device.
Figure 60:
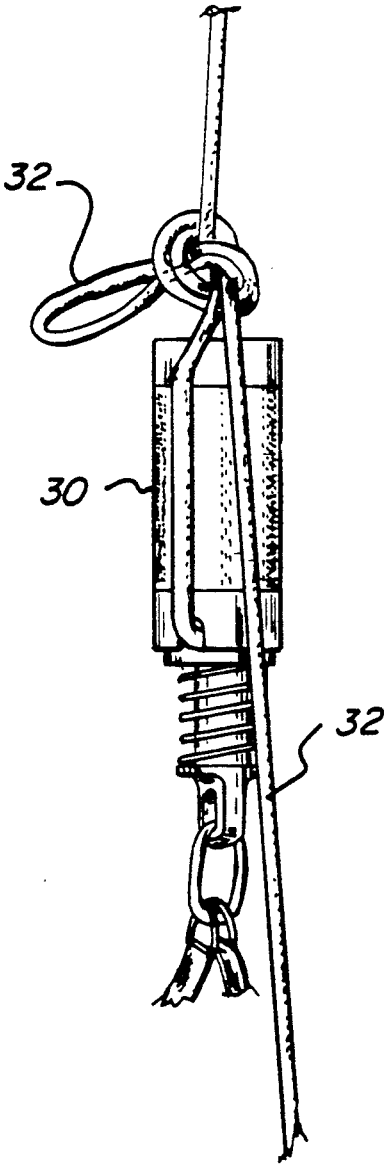
FIG. 60 illustrates an alternative system for tying the descent rope to prevent inadvertent descent of the controller.
Figure 59:
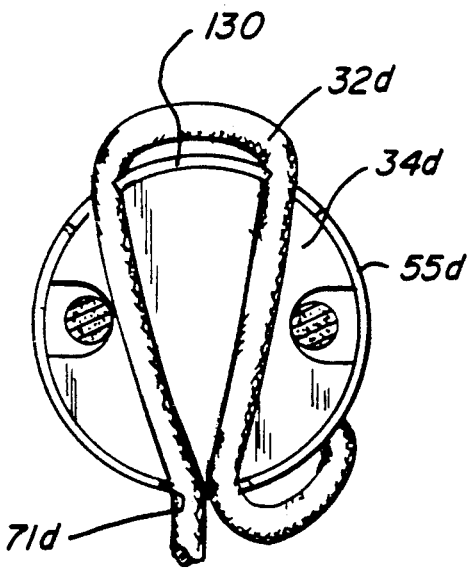
FIG. 59 is a top plan view of the descent controller shown in FIG. 57.
Figure 57:
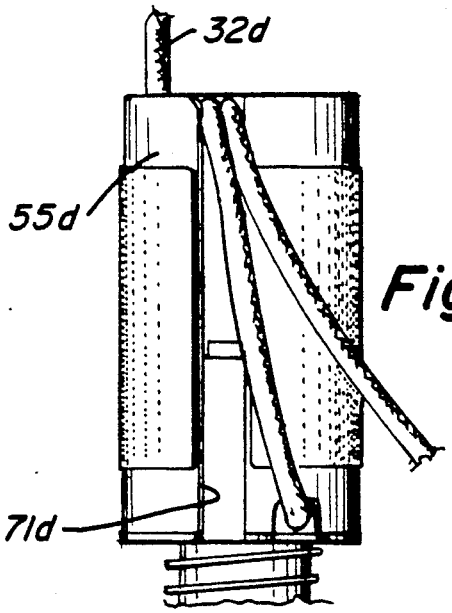
FIG. 57 is a front elevation view of a descent controller of the type shown in FIG. 24 using a gripping sleeve as shown in FIG. 56.
Figure 58:
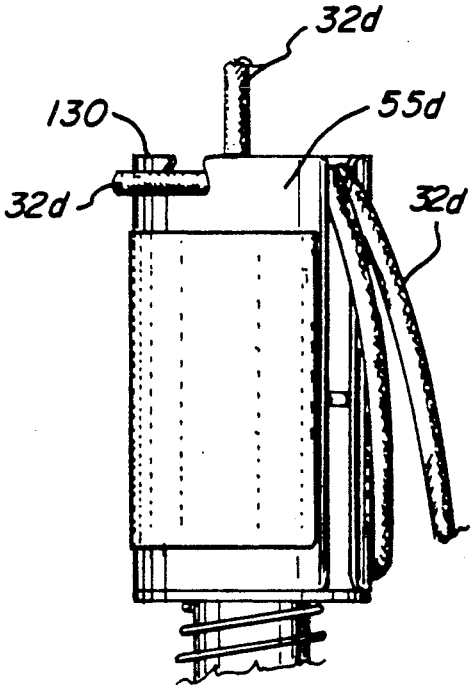
FIG. 58 is a side elevation view of a descent controller of the type shown in FIG. 24 using a gripping sleeve as shown in FIG. 56.

A ladder form of capstan is shown in FIGS. 44-51. A safety kit or system is shown in FIGS. 52-54. A rescue use of the descent controller is shown in FIG. 55. A releasable rope securing mechanism is shown in FIGS. 57-59. A rope tie-off method is shown in FIG. 60.

The controller finds substantial but not necessarily exclusive utility as a device for enabling descent from scaffolding, lifts, forklifts, trucks, stock pickers, snorkels, cranes, window washing platforms and the like.

In the basic descent controller as shown in FIGS. 1-19, the capstan or friction cylinder 31 includes an upper flange 34 adjacent its upper end and a lower flange 35 nearer but spaced from the lower end of the capstan cylinder 31. Juxtaposed with the lower end of the capstan cylinder 31 is a diametric aperture or bore 36 defined therein for receiving a supporting rope, hook, loop or the like 38 for engaging and supporting a load suspension structure or harness 39. Each of the top and bottom or upper and lower flanges 34, 35 includes a rope receiving guide notch 40, 41 respectively, defined therein for receiving an inserted portion of the rope 32. The rope 32 is wound in a number coils or turns 42 about the capstan or friction cylinder 31 between the upper and lower flanges 34, 35.

For controllably gripping the rope, the lower end of the capstan or cylinder 31, being the portion extending below the lower flange 35, is provided with a diametrically extending upwardly tapered slot 44, of generally teardrop shape. The slot 44 tapers from a lower enlarged end 45 which loosely receives the rope 32 to an upper narrow or gripping end 46 which frictionally grips the rope 32. A rope 32 passing through the lower open end 45 of the slot 44 moves freely through the slot. However, the rope is tightly gripped and restrained by the upper or narrower end 46 of the slot 44.

Figure 1:
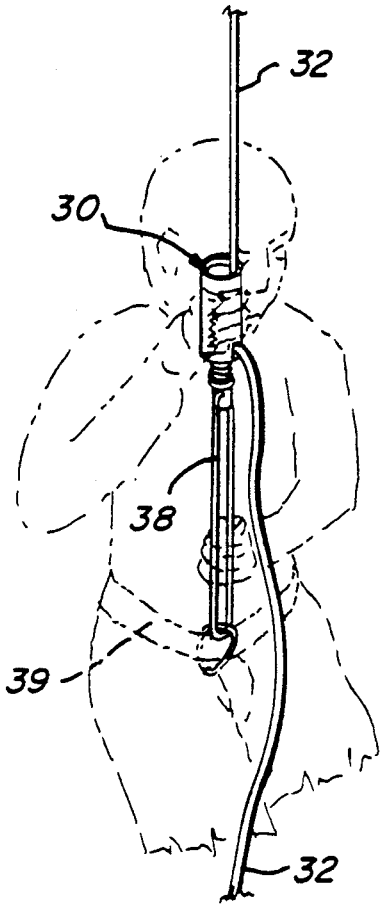
FIG. 1 a perspective view illustrating how a descent controller embodiment the present invention is utilized by a user supported in a harness suspended from the controller for descent along a supporting rope.
Figure 2:
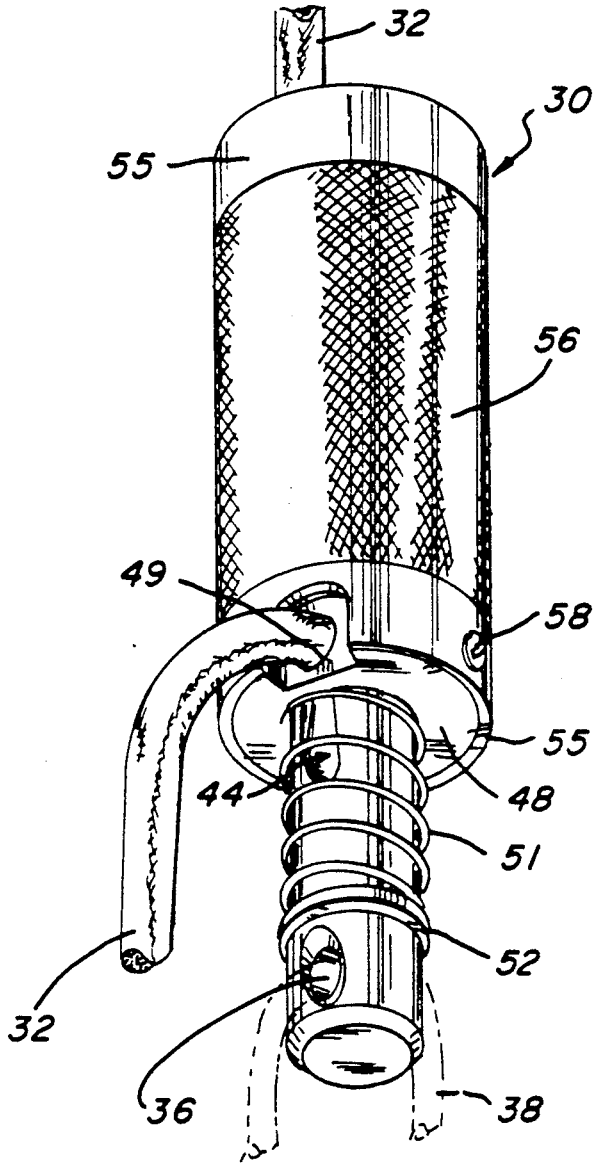
FIG. 2 is an enlarged perspective view of the descent controller embodying the present invention mounted on a supporting rope.
Figure 3:
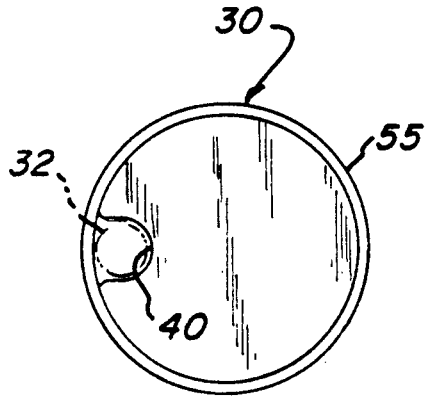
FIG. 3 is a top plan view of the descent controller shown in FIG. 2.
Figure 4:
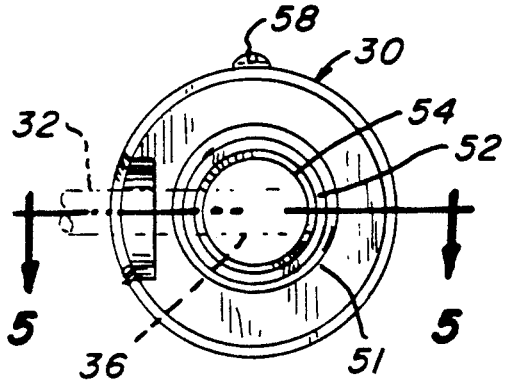
FIG. 4 is a bottom plan view of the descent controller shown in FIG. 2.
Figure 5:
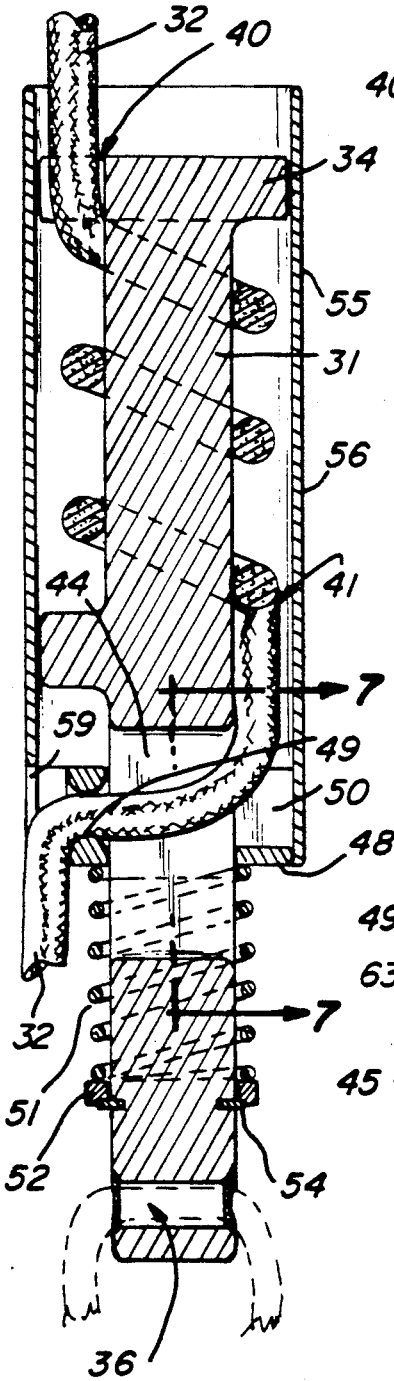
FIG. 5 is a section view taken substantially in the plane of line 5—5 on FIG. 4.
Figure 6:
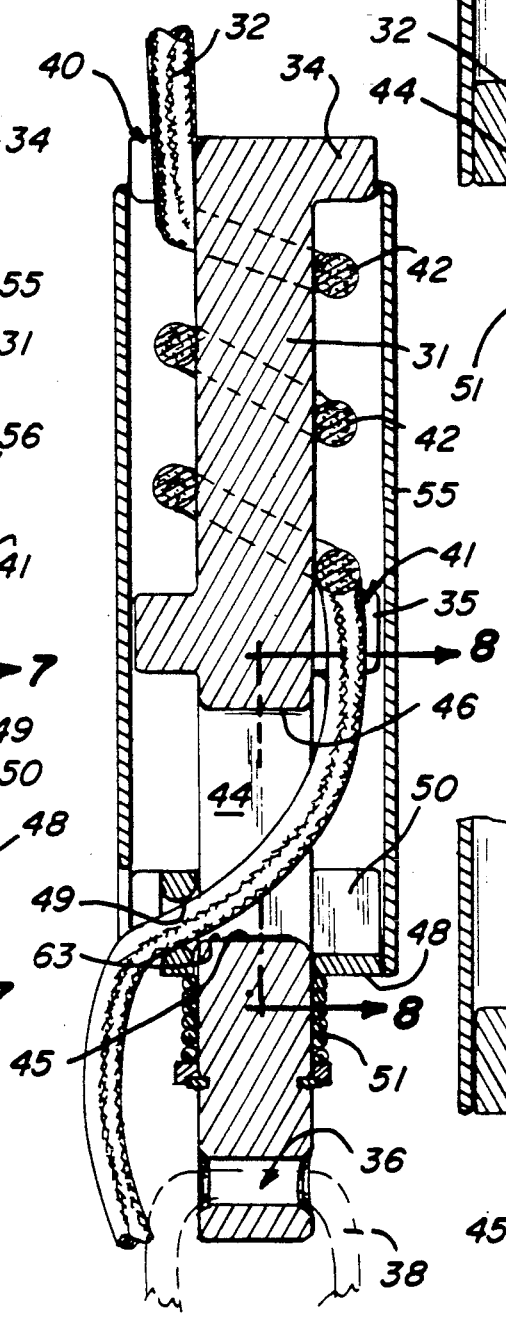
FIG. 6 is a section view similar to FIG. 5 but showing the descent controller released in rope descending configuration.
Figure 7:
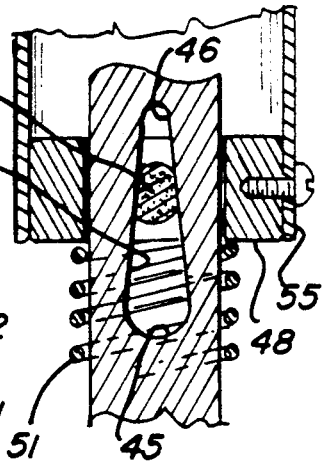
FIG. 7 is a section view taken substantially in the plane of line 7—7 on FIG. 5.
Figure 8:
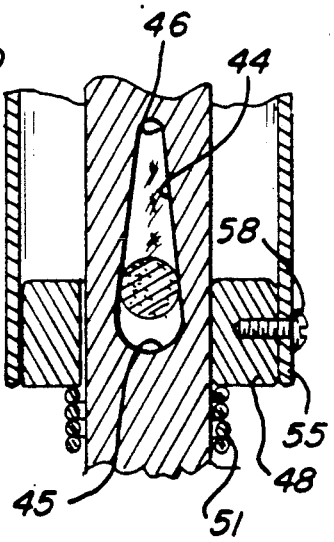
FIG. 8 is a section view taken substantially in the plane of line 8—8 on FIG. 6.
Figure 9:
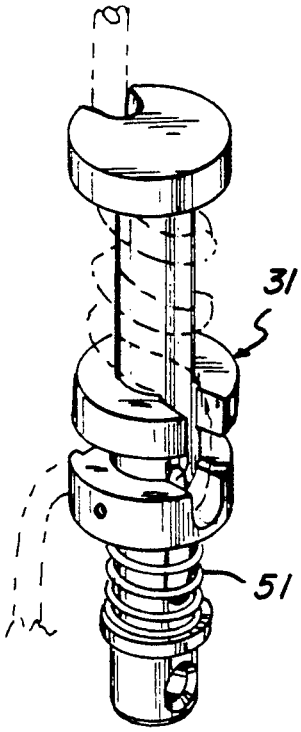
FIG. 9 is a perspective view of a capstan and rope clamping control ring as shown in FIGS. 2 and 5, but with the cover removed.
Figure 11:
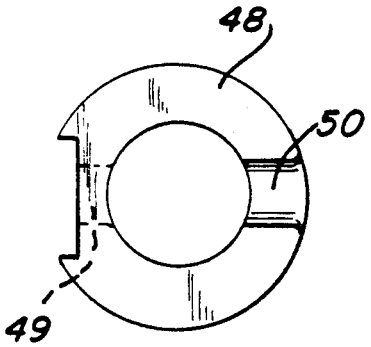
FIG. 11 is an enlarged top plan view of the clamping ring taken substantially in the plane of line 11—11 on FIG. 10.
Figure 12:
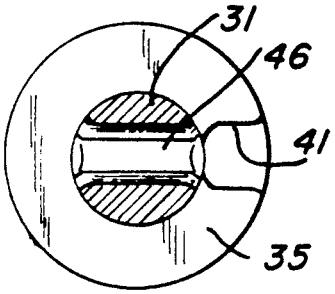
FIG. 12 is an enlarged section view taken substantially in the plane of line 12—12 on FIG. 10.

For positively positioning the rope 32 in either the lower enlarged end 45 or upper constricted end 46 of the slot 44, there is provided an annular sleeve or control ring 48 slidably mounted on the lower or depending end of the friction cylinder or capstan 31 as shown in FIGS. 5 and 6. The control ring 48 includes a radial aperture 49 defined therein for loosely receiving the rope 32. The edges of the aperture 49 may be chamfered or rounded to reduce cutting of or damage to the rope. The sliding control ring also includes a recess 50 for receiving the rope allowing the rope to pass freely through the enlarged lower end of the tapered slot 44 with reduced interference from the positioning ring 48 when the ring is in its lower position, as well as for receiving the rope to allow the ring to force or jam the rope into the narrow tapered slot 44 when the ring 48 is in its upper position. The ring is biased towards its upper rope gripping position by a coil spring 51 or other appropriate biasing device. The spring 51 is supported on a T-shaped cross-section shoulder ring 52 secured by a spiral retaining ring 54 engaging in a groove 53 in the lower end of the friction cylinder 31 adjacent the load supporting aperture 36.

The control ring 48 is adapted to be moved up and down over the capstan cylinder 31. To this end, a tubular sleeve or housing 55 is secured thereto and extends in surrounding covering relation with the capstan 31, rope turns, and both the upper and lower flanges 34, 35 on the capstan. The housing 55 is provided with a knurled, grooved or roughened outer surface 56 to enable a user to readily grip the housing surface without slipping, in order to position the control ring 48 in either locking or descent position. The housing is secured to the control ring 48 by one or more screws 58 extending through an aperture 59. Other appropriate spring biased latches or detents may be utilized in the cylinder sleeve 55 and threadably engaged in a threaded hole 60 in the control ring 48. Adjacent its lower edge the housing 55 is provided with a longitudinal peripheral notch 59 which corresponds with the rope aperture 49 of the control ring 48 and through which the rope 32 loosely extends.

In order to keep the gripping sleeve 56 and control ring 48 from rotating on the capstan cylinder 31, which could cause the rope to bind or jam during descent, the housing mounting screw 58 may be provided with an elongated tip 61 which extends through the control ring hole 60 into a longitudinal groove 62 in the external surface of the capstan extension, as shown in FIGS. 13-17.

The device as described also provides for a panic stop because a hard, pull-down force on the sleeve and control ring will jam the rope between the control ring and the bottom edge 63 of the tapered slot 44 thereby pinching the rope and creating a substantial drag on it. Thus, if a user panics and pulls down hard on the control housing 55 and control ring 48, the device will stop or retard further descent until the downward force on the control housing and ring is eased. In the event of a deadman fall on the other hand, the control ring will jam the rope in the upper tapered end of the slot to prevent or retard further descent. The device thus provides for a stop or controlled descent under both deadman and panic conditions.

Figure 10:
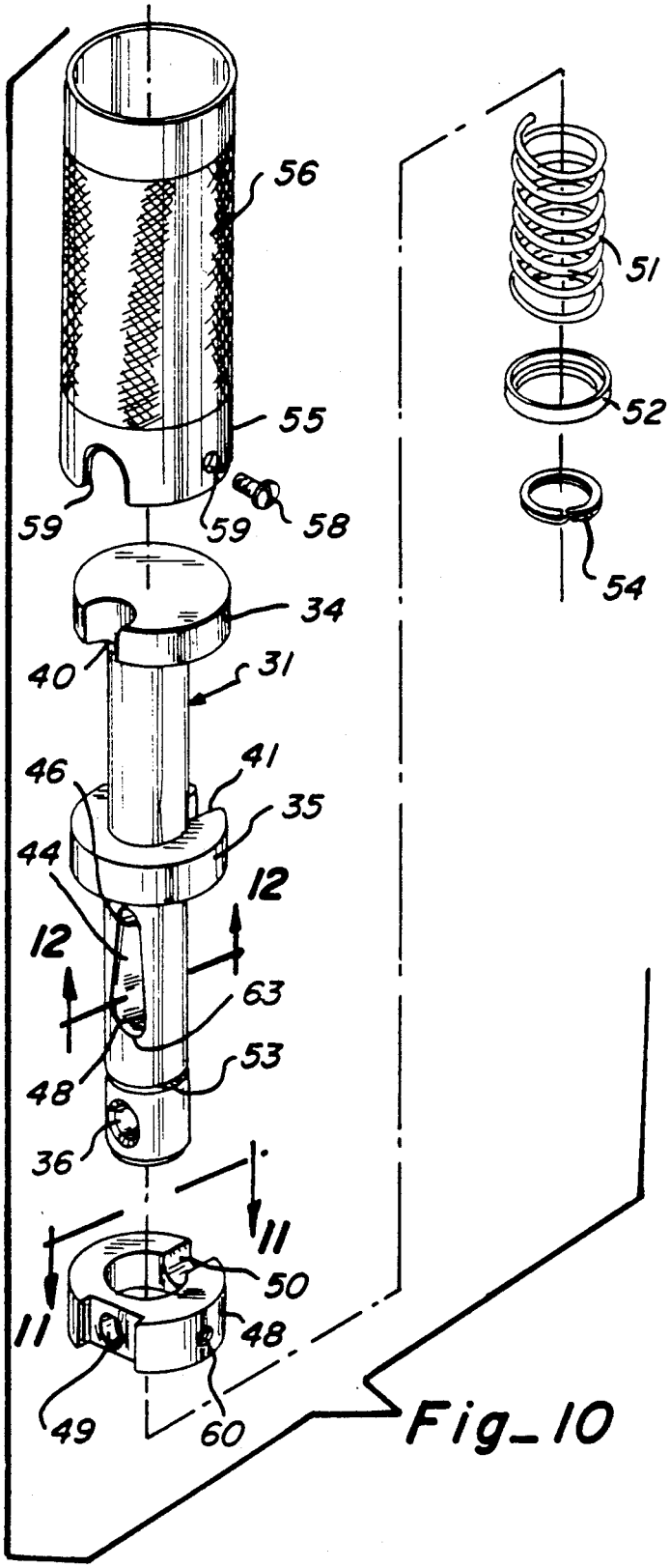
FIG. 10 is an exploded perspective view, somewhat reduced in size, of the descent controller shown in FIG. 2.
Figure 13:
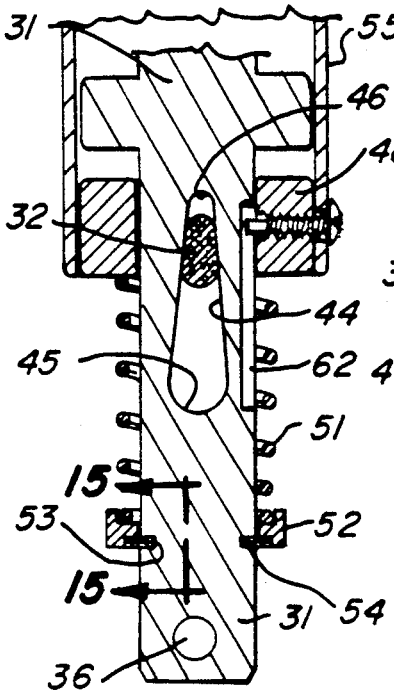
FIG. 13 is a section view similar to FIG. 7 but showing a modified form of clamping ring and locking screw.
Figure 14:
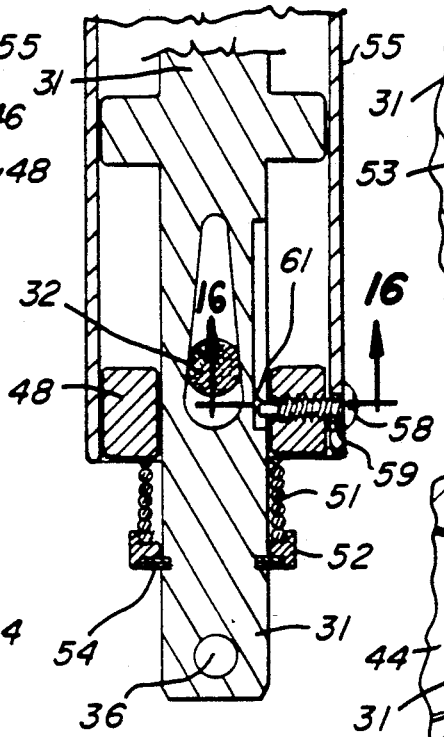
FIG. 14 is a section view similar to FIG. 8 but showing a modified form of clamping ring and locking screw.
Figure 15:
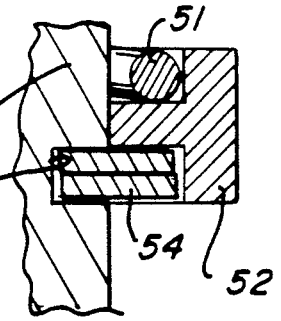
FIG. 15 is an enlarged section view taken substantially in the plane of line 15—15 on FIG. 13.
Figure 16:
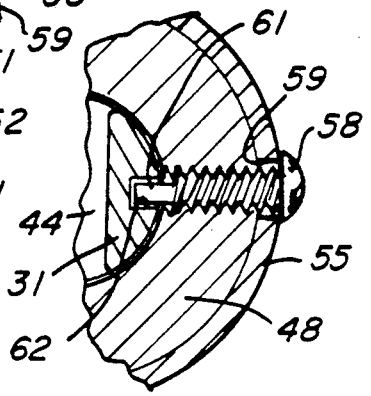
FIG. 16 is an enlarged section view taken substantially in the plane of line 16—16 on FIG. 14.
Figure 17:
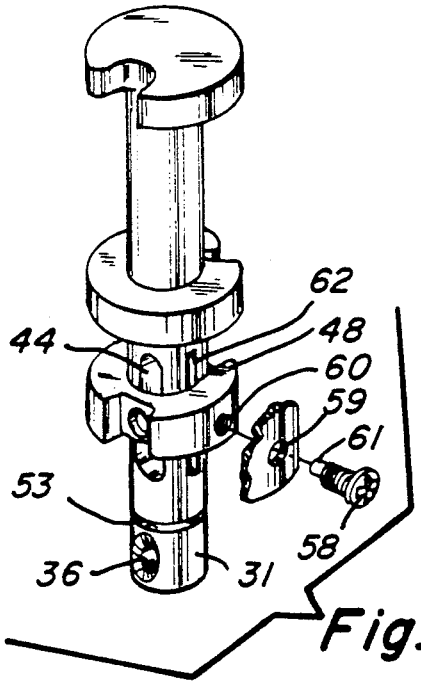
FIG. 17 is a reduced perspective view of the descent controller with portions cut away or removed for clarity and illustrating the modified form of clamping ring and locking screw shown in FIG. 13.
Figure 18:
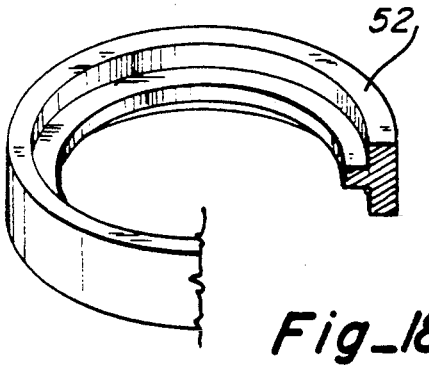
FIG. 18 is an enlarged perspective view with a portion cut away for clarity of the actuating spring mounting ring utilized on the modification of the descent controller shown in FIG. 13.
Figure 19:
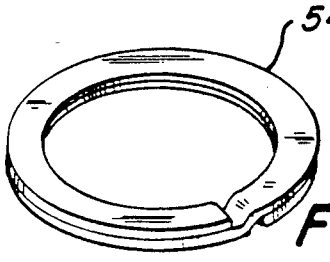
FIG. 19 is an enlarged perspective view of a spiral lock ring.

An alternative controller modification, adopted for controlling the descent of a load by an operator at a lower level is shown in FIGS. 20-23. In describing this modification reference characters similar to those utilized above will be employed with the distinguishing suffix "b". This modified form **30*b* of the controller is adapted to be controlled or operated by pulling on or releasing the free end of the rope 32*b*, down which the descent controller 30*b* is sliding. To this end, the tapered slot 44*b* in the lower end of the capstan cylinder 31*b* is inverted as compared to the arrangement of the tapered slot 44 as shown in FIG. 10, so that the wider end 45*b* of the slot is up as compared to the load supporting aperture 36*b*, and the narrower end 46*b* is down. In other respects, the construction of the modified unit 30*b* is identical to the preferred device 30 as shown in FIGS. 1-19**.

In operation, the modified descent controller **30*b* is controlled by pulling on or releasing the free end of the rope 32*b*. Releasing the tension in the rope 32*b* allows the control ring 48*b* under the bias of the spring 51*b*, to position the rope in the wide end 45*b* of the inverted tapered slot 44*b*, thereby allowing the controller 30*b* and load L to slide down the rope 32*b*, as shown in FIGS. 20 and 21. To stop or slow the descent, the operator pulls on the free end of the rope 32*b*, thereby wedging the rope into the narrower end 46*b* of the tapered slot 44*b* against the force of the spring 51*b* and control ring 48*b***.

A similar result can be obtained by pulling down on the housing **55*b* and control ring 48*b*. The tapered slot 44*b* through which the rope 32*b* passes is inverted as compared to the tapered slot 44 in the modification shown in FIGS. 1-19, with the larger end 45*b* of the slot upper most and the constricted or narrower end 46*b* downwardly nearer the load supporting end of the capstan cylinder 31*b*, as shown in FIGS. 20-23**.

A modified preferred form of the present invention is shown in FIGS. 24-43 inclusive. In describing this modification, reference numerals similar to those used in the description of the device shown in FIGS. 1-19 will be employed with the distinguishing suffix "a". The additional function of this modification is to enable the user to mount the descent controller 30*a* on a rope 32*a* at a point intermediate the ends thereof, without utilizing either the upper or the lower end of the rope. This feature is important in situations in which the user desires to shift the position of the descent controller on a rope when the rope ends are not accessible. This may be important, for example when the user is on a moving scaffold or platform which can be stopped at different levels, necessitating continuous changes of the position of the descent controller on a safety rope.

As shown in FIGS. 24–43, the capstan or cylinder 31*a* of the descent controller 30*a* is constructed essentially as described above, and includes an upper flange 34*a* and lower flange 35*a* nearer but spaced from the lower end of the capstan cylinder 31*a*. The capstan cylinder 31*a* also includes a diametric aperture or bore 36*a* for receiving a load supporting device or harness (not shown. Intermediate the lower flange 35*a* and the load supporting bore 36*a*, there is provided a diametrically extending upwardly tapered slot 44*a*. The slot 44*a* is of generally teardrop shape and tapers from a lower enlarged or crude end 45*a*, which loosely receives the rope 32*a*, to an upper narrow or gripping end 46*a*, in which the rope is tightly gripped. A rope 32*a* passing through the lower open end 45*a* of the slot 44*a* moves freely through the slot. However, the rope is gripped and restrained by engagement in the upper or narrower end 46*a*.

Figure 29:
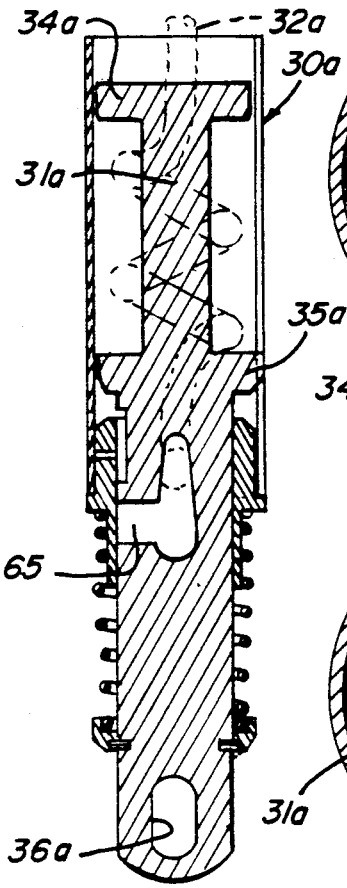
FIG. 29 is a section view taken substantially in the plane line 29—29 on FIG. 28.
Figure 30:
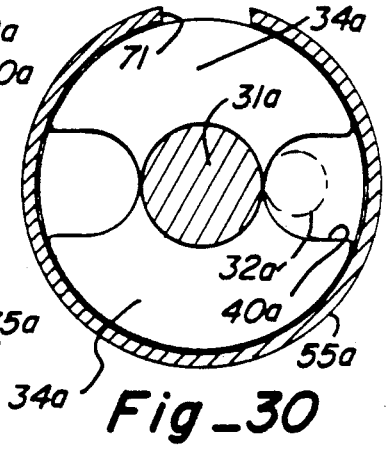
FIG. 30 is an enlarged section view taken substantially in the plane of line 30—30 on FIG. 28.
Figure 31:
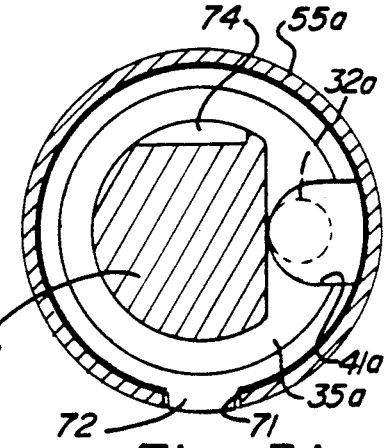
FIG. 31 is an enlarged section view taken substantially in the plane of line 31—31 on FIG. 28.
Figure 32:
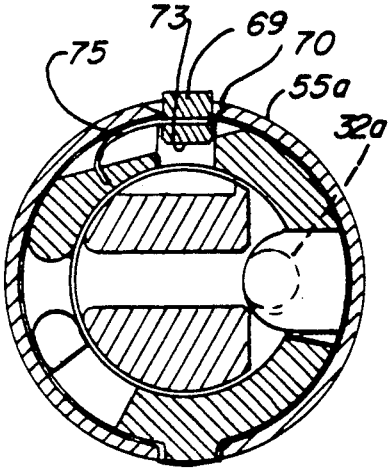
FIG. 32 is an enlarged section view taken substantially in the plane of line 32—32 on FIG. 28.
Figure 33:
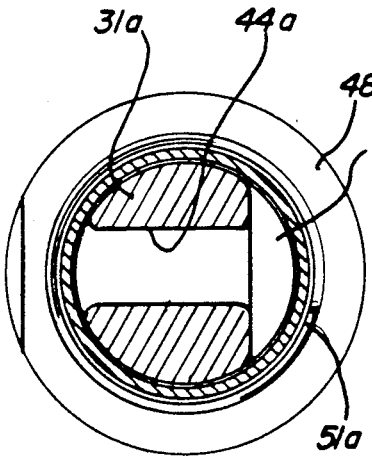
FIG. 33 is an enlarged section view taken substantially in the plane of line 33—33 on FIG. 28.
Figure 34:
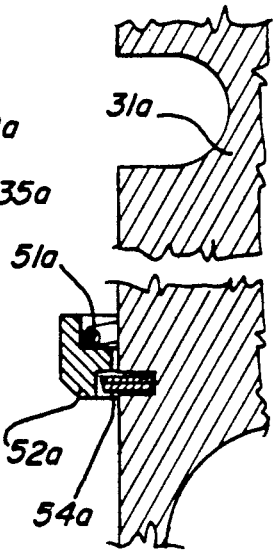
FIG. 34 is an enlarged section view taken substantially in the plane of line 34—34 on FIG. 28.
Figure 35:
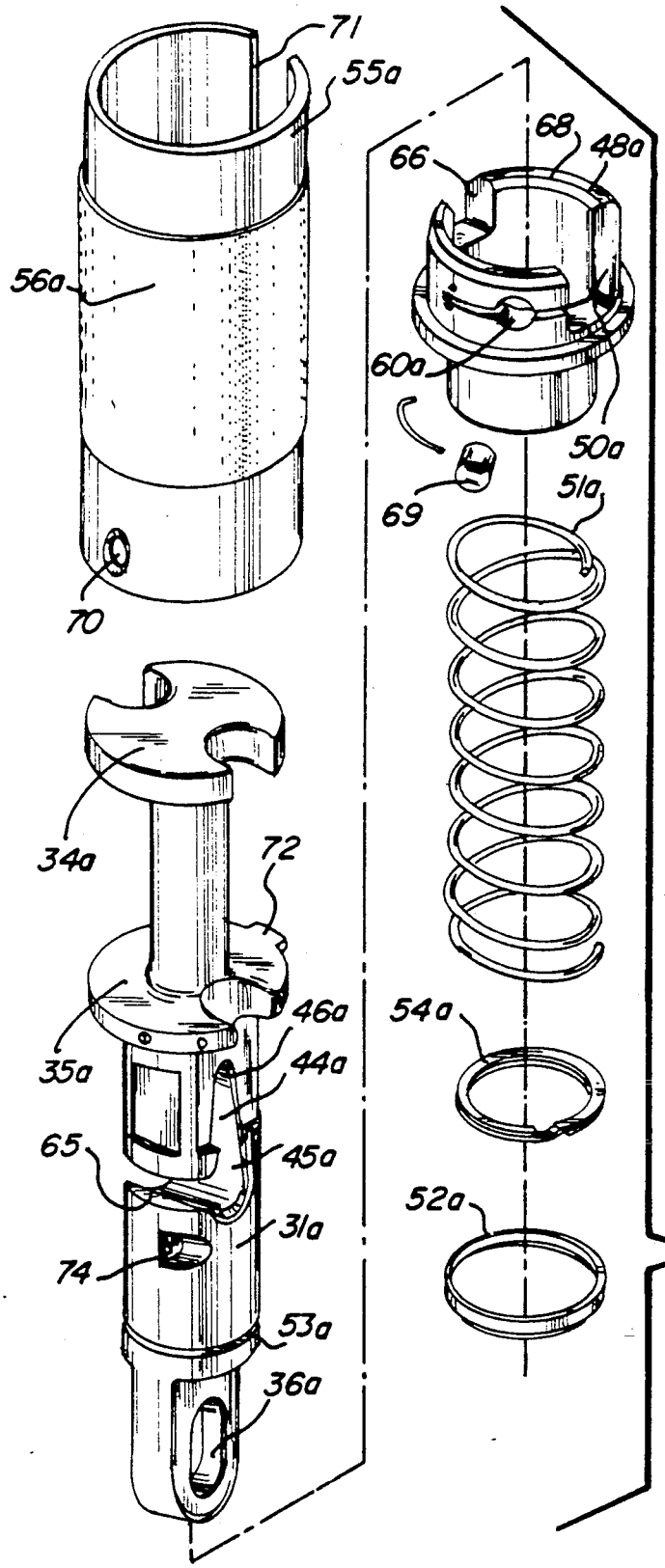
FIG. 35 is an exploded perspective view of the descent controller shown in FIG. 24.
Figure 36:
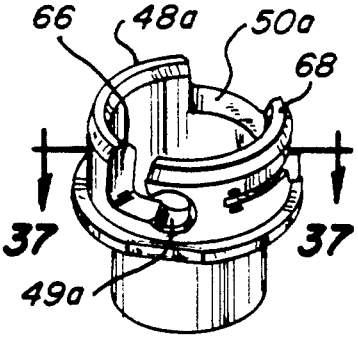
FIG. 36 is a perspective view of the clamping ring and detent of the descent controller shown in FIGS. 24 and 35.

In order to enable the rope to be inserted into or removed from the tapered slot 44*a* without utilizing an end of the rope 32*a*, a radial slot 65 opens through the side wall of the capstan cylinder 31*a* into the tapered slot 44*a*, as shown in FIGS. 29 and 35. The radial slot 65 enables the rope 32*a* either to be inserted into or removed from the tapered slot 44*a*, so that the rope can be wrapped around the friction cylinder or capstan 31*a* or removed from the capstan. With this construction, the controller device 30*a* can be mounted on the rope 32*a* at any point on the rope intermediate its ends without using either the upper or lower end of the rope or removing the rope from its point of securement.

As described above, for selectively positioning the rope in either the lower enlarged end 45*a* or upper constricted end 46*a* of the slot 44*a*, there is provided an annular sleeve or control ring 48*a* slidably mounted on the lower or depending end of the friction cylinder 31*a* adjacent the tapered slot 44*a*. The annular control ring 48*a* includes a radial aperture 49*a* defined therein for loosely receiving the rope 32*a*. The edges of the aperture 49*a* are chamfered or rounded to prevent cutting or damaging the rope as it passes through the aperture 49*a*. To enable the rope to be inserted or removed from the radial aperture without threading an end of the rope therethrough, while providing for insertion of a section of the rope, an axially directed groove or notch 66 opens from the upper face 68 of the ring into the aperture 49*a*. The sliding control ring 48*a* also includes a recess 50*a* for receiving the rope, allowing the rope to pass freely through the enlarged lower end of the tapered slot 44*a* without interference from the positioning or control ring, when the ring is in its lower position, as well as for receiving the rope to allow the exit aperture 49*a* to force or jam the rope into the narrow tapered slot 44*a* when the ring 48*a* is in its upper position.

As described above, the ring is biased towards its upper position by a coil spring 51*a* or other appropriate biasing device. The spring 51*a* is supported on a shoulder ring 52*a* secured by a spiral retaining ring 54*a* engaged in a peripheral groove 53*a* in the lower end of the friction cylinder 31*a* adjacent the load supporting aperture 36*a*.

The control ring 48*a* is adapted to be moved up and down over the capstan cylinder 31*a* by a tubular sleeve or housing 55*a* secured thereto and extending in surrounding relation with the capstan 31*a*, rope turns thereon, and upper and lower flanges 34*a*, 35*a* respectively. The housing 55*a* is provided with a roughened, knurled or grooved outer surface 56*a* to enable a user to grip the housing surface. The roughened surface may be provided by a sandpaper-like tread sheet of the character commonly used on floors and stairs to prevent slipping.

The housing is removably secured to the control ring 48*a* by a spring biased detent 69 in the form of a pin or button housed in a mating aperture 70 defined in the lower end of the housing sleeve 55*a*. The housing cylinder 55*a* defines an axially extending slot 71 which enables the housing to be slipped over the rope 32*a* at any point along the length of the rope intermediate its ends. By separating the housing from the control ring 48*a* and capstan cylinder 31*a*, the housing may be slipped off of or onto the rope at any point along the length thereof. Likewise, the rope may be removed from or wrapped around the friction cylinder 31*a* at any point along the length of the rope, and the rope can be inserted into or removed from the tapered control slot 44*a* by squeezing it through the access slot 65. For guiding the housing cylinder 55*a* on the capstan cylinder 31, the lower flange 35*a* may include a radially extending boss 72 adapted to be inserted into the axial slot 71 on the housing cylinder 55*a*. The housing cover 55*a* thus is retained at its proper rotational position with respect to the flanges, control ring and friction cylinder.

Figure 37:
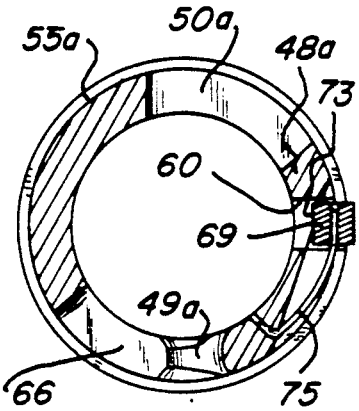
FIG. 37 is an enlarged section view taken substantially in the plane of line 37—37 on FIG. 36.
Figure 44:
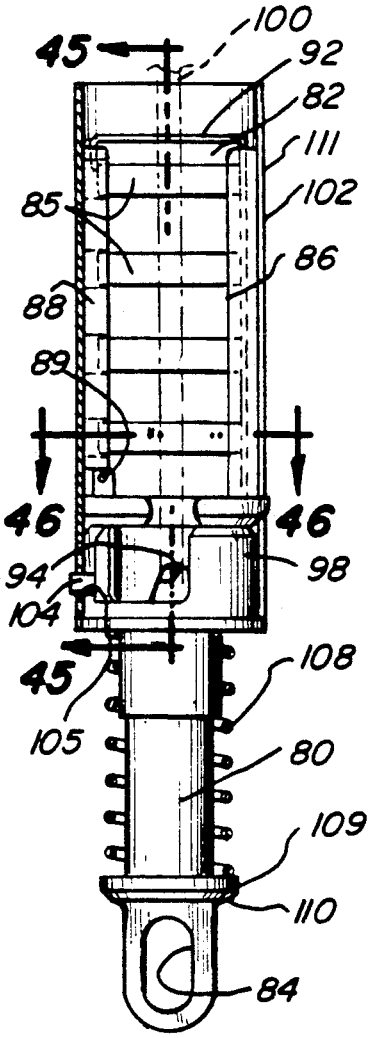
FIG. 44 is an elevation view partly in section of modified form of descent controller utilizing a ladder-type capstan arrangement.
Figure 45:
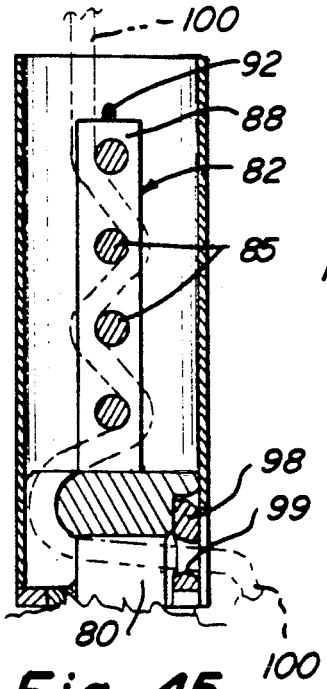
FIG. 45 is a section view taken substantially in the plane of line 45—45 on FIG. 44.
Figure 46:
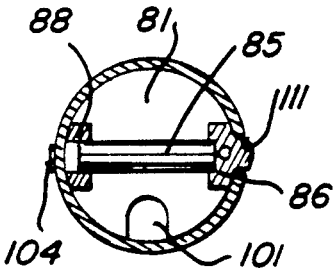
FIG. 46 is a section view taken substantially in the plane of line 46—46 on FIG. 44.

For retaining the control ring 48*a* in a retracted position during the insertion or removal of a section of the rope 32*a*, the detent 69 extends radially through an aperture 60 in the ring 48*a* to a point where its inner end 73 is engagable in a locking slot 74 in the capstan cylinder 31*a* below the radial access slot 65, to retain the ring in the retracted position. The rope can then be inserted in place in the grooves 50*a*, 66 in the control ring, as shown in FIGS. 40–43, and thereafter the ring can be released and rotated to position the rope in the control aperture 49*a*. The detent is biased outwardly by a cantilever spring 75 secured in the exterior wall of the control sleeve 48*a* and having an end engaged with the detent 69, as shown in FIG. 37. The spring loaded push button detent 69 releasably retains the sleeve housing 55*a* on the control ring 48*a* and further serves to hold the control ring 48*a* in a retracted position during removal or insertion of the rope.

Figure 24:
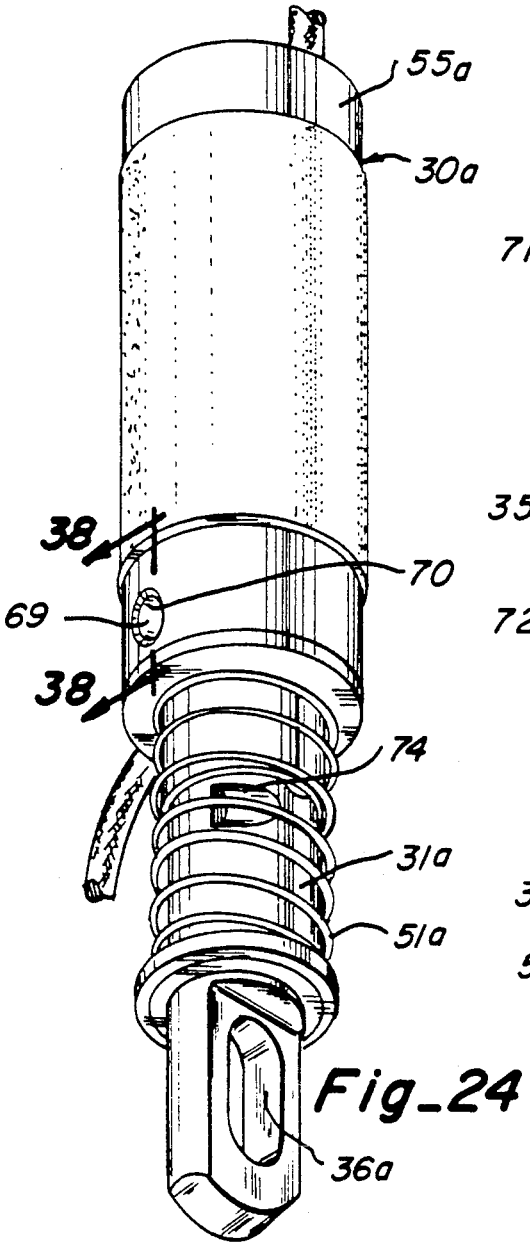
FIG. 24 is a front perspective view of a modified form of descent controller embodying the present invention adapted for mounting on a rope at a point intermediate the ends thereof.
Figure 25:
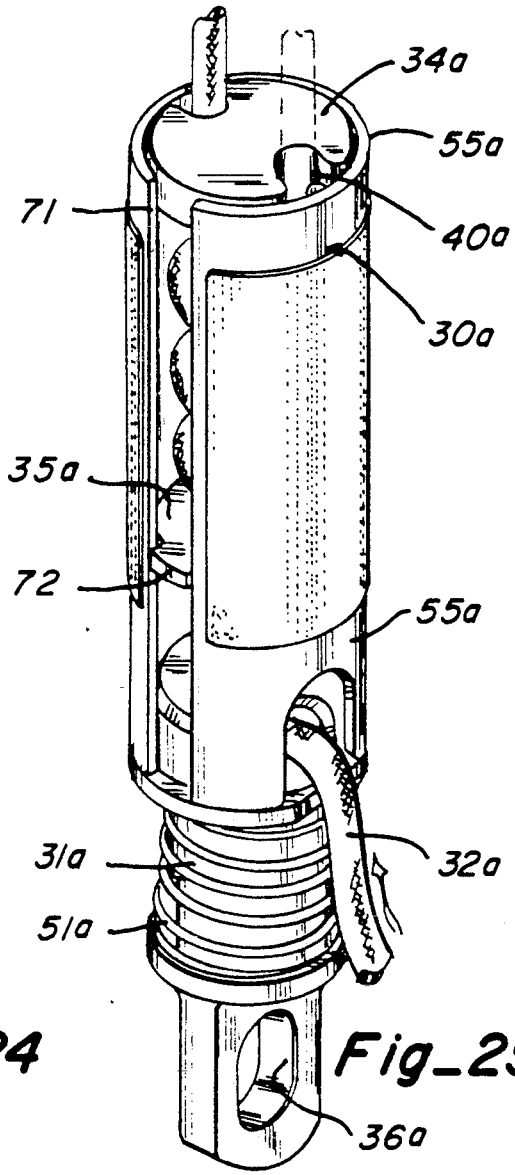
FIG. 25 is a rear perspective view of the modified form of descent controller shown in FIG. 24.
Figure 26:
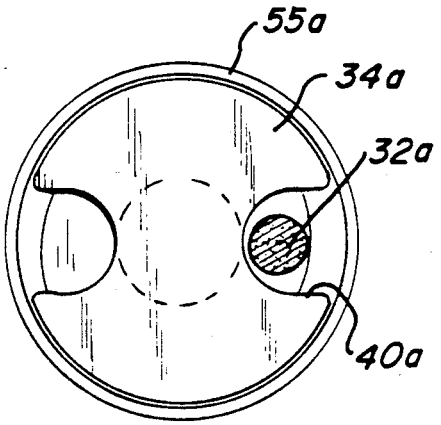
FIG. 26 is an enlarged top plan view of the descent controller shown in FIG. 24.
Figure 27:
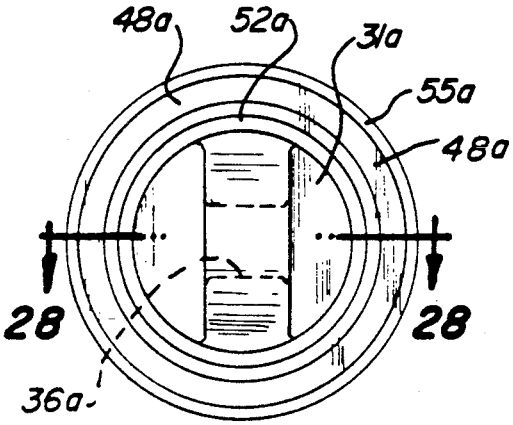
FIG. 27 is an enlarged bottom plan view of the descent controller shown in FIG. 24.
Figure 28:
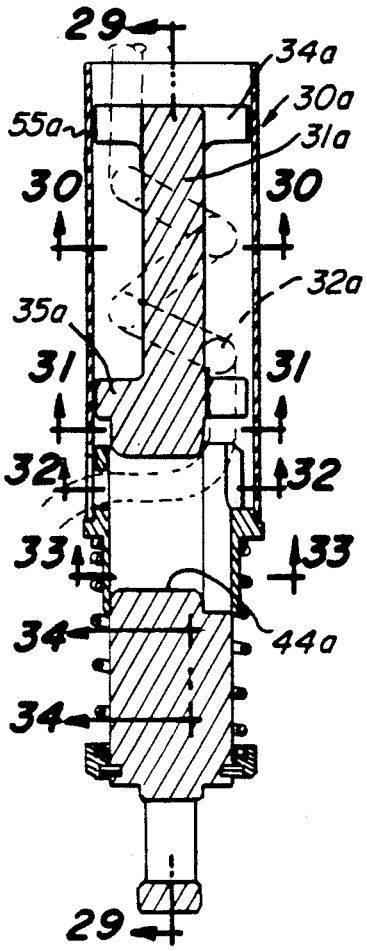
FIG. 28 is a reduced size section view substantially in the plane of line 28—28 on FIG. 27.

To mount a controller device of the type shown in FIGS. 24 and 25 on a rope hanging from one end at an upper elevation downwardly to a lower elevation the handle or housing 55*a* is removed from the assembly by pushing the detent button and releasing the housing. The control ring is then pulled downwardly against the force of the spring 51*a* with respect to the capstan to position the ring below the tapered slot 44. At this point, the detent 69 is pushed and engages in the locking slot 74 to lock the control ring 48*a* in its lowered position as shown in FIG. 43. The control ring, when pulled down, must be turned partially to allow the detent 69 to engage in the locking slot 74 in order to lock the control ring 48*a* against the force of the spring 51*a*.

With the capstan 31*a* exposed, the rope 32*a* is wound around the main capstan body the desired number of turns and is inserted into the receiving slot 40*a* in the upper plate 34*a* and a similar slot 41*a* in the lower plate 35*a*. Below the lower plate 35*a* the rope is inserted into the tapered slot 44*a* by passing the rope through the entrance slot 65. Simultaneously the rope is placed for reception in the control ring aperture 49*a* by positioning it above the control ring slot 50*a* and the throat 66 into the control ring aperture 49*a*. During this assembly of the rope and control device, the spring 51*a* remains compressed.

After assembling the control device on the rope, the control ring 48*a* is turned and pulled slightly downwardly to release the detent 69, and is allowed to slide upwardly on the capstan. The housing sleeve 55*a* is then mounted in place by inserting the rope 32*a* through the longitudinal slot 71 and sliding the housing 55*a* downwardly over the capstan 31*a*, entrained rope 32*a* and control ring 48*a*. The detent receiving opening 70 in the housing 55*a* is positioned for receiving the detent button 69 to lock the housing in place. After assembly, both the housing and control ring may then be pulled downwardly to release the rope, or allowed to slide upwardly to position the rope in the narrow end of the tapered slot.

To remove the control device from the rope, the above procedure is reversed by removing the housing 55*a*, and then pulling downwardly on the control ring 48*a* and rotating the ring to release the rope from the tapered throat.

As shown in FIG. 38, the control ring cannot be slid with respect to the capstan unless the detent button is outwardly positioned with respect to the housing. A recess in the capstan allows the detent button to be pushed only when the ring 48*a* has been rotated to the release position, as shown in FIG. 38.

A further modification is shown in FIG. 39. In order to be able to hang or support the sleeve 55*a* during assembly of the rope, a belt hook 75 is provided on the upper end of the sleeve 55*a*. This assembly includes a band 76 surrounding and secured to the exterior surface of the sleeve 55*a* adjacent its upper end, and a hook 77 to go with the band and adapted to be engaged in the user's belt or on any other appropriate support.

A further modification of the present invention utilizing a rack or ladder capstan arrangement is shown in FIGS. 44–51. A rack or ladder capstan device for a single rope is shown in FIGS. 44–47, while a similar rack or ladder construction for a two-rope system is shown in FIGS. 48–51. The rack capstan arrangement provides a functional resistance between a rope 100 and the descent device, allowing a controlled descent of a load secured to the device without the inherent rope twisting experienced with the axial cylindrical capstan devices.

Referring to FIGS. 44–47, the ladder or rack form of the controller embodies a generally cylindrical body 80 having a flange 81 at one end thereof supporting a rack capstan arrangement 82. At its other end, the body 80 defines an aperture 84 adapted for securing the device to a load or load-supporting assembly such as a harness (not shown). The capstan assembly 82 comprises a plurality of coplanar vertically arranged generally horizontally spaced apart bars or rods 85 supported at their opposite ends by spaced parallel support panels 86, 88, secured in upstanding relation on the end flange 81. One of the panels 88 is preferably hinged to the support flange 81 by an appropriate hinge structure 89.

Each of the support panels 86, 88, defines an array of apertures 90 for receiving inserted ends of the capstan bars or rods 85. A latch pin 92 engaged between the side panels 86, 88 holds the side panels together with the rods 85 securely supported therebetween.

For selectively gripping or releasing the rope 100, the support post or cylinder body 80 includes, at a point adjacent the support platform or flange 81, a tapered slot 94 extending diametrically therethrough and having a lower wider end 95 and an upper narrower end 96. The wider end 95 is of a dimension to freely pass the rope 100 while the narrower end 96 serves to grip a rope wedged therein. For purposes of wedging a rope 100 in the narrower end of the tapered slot 94 or releasing the rope and positioning it in the wider end for movement through the slot, there is provided a control ring 98 slidably mounted on the support body 80 and having a radial aperture 99 extending therethrough for receiving the rope 100 so that the control ring 98 guides the rope into or out of the narrow end 96 of the tapered slot 94 in the same manner as described in detail above.

Figure 47:
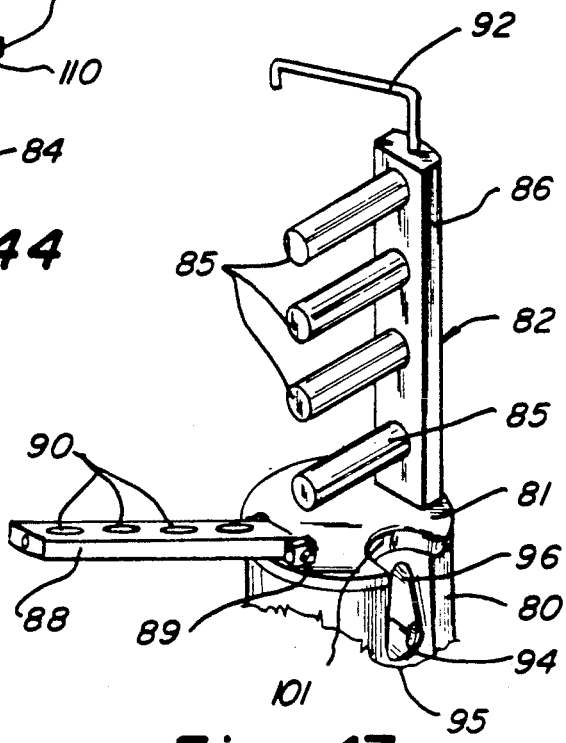
FIG. 47 is a partial perspective view of the descent controller shown in FIG. 44 but with the outer cylindrical cover removed and showing the ladder capstans opened for rope engagement.
Figure 48:
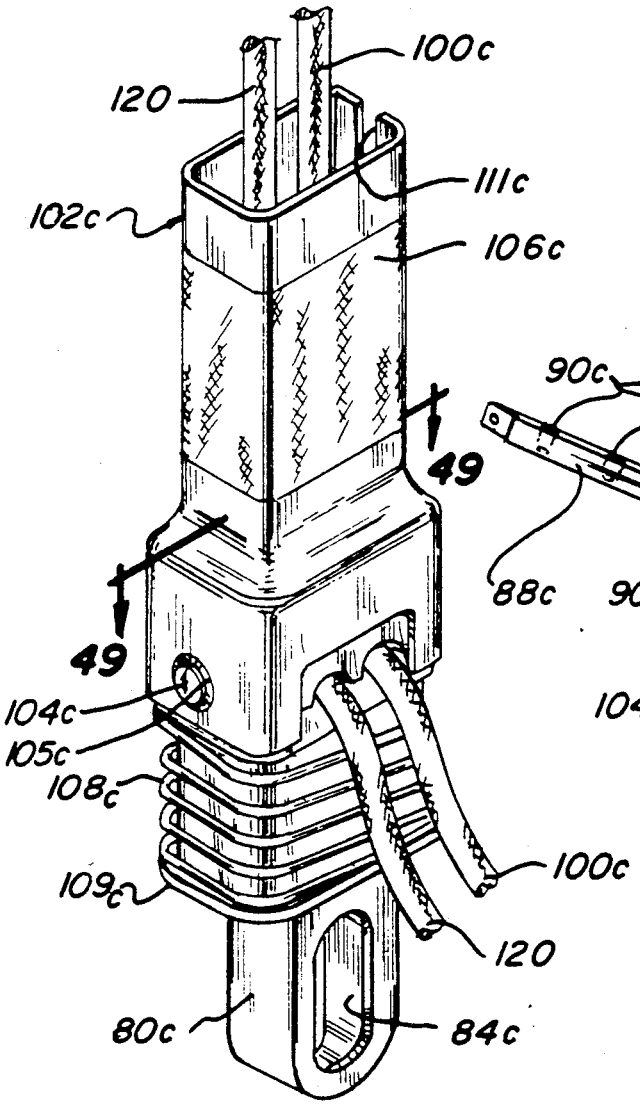
FIG. 48 is a perspective view of a modified form of descent controller including ladder-type capstans and double ropes.
Figure 50:
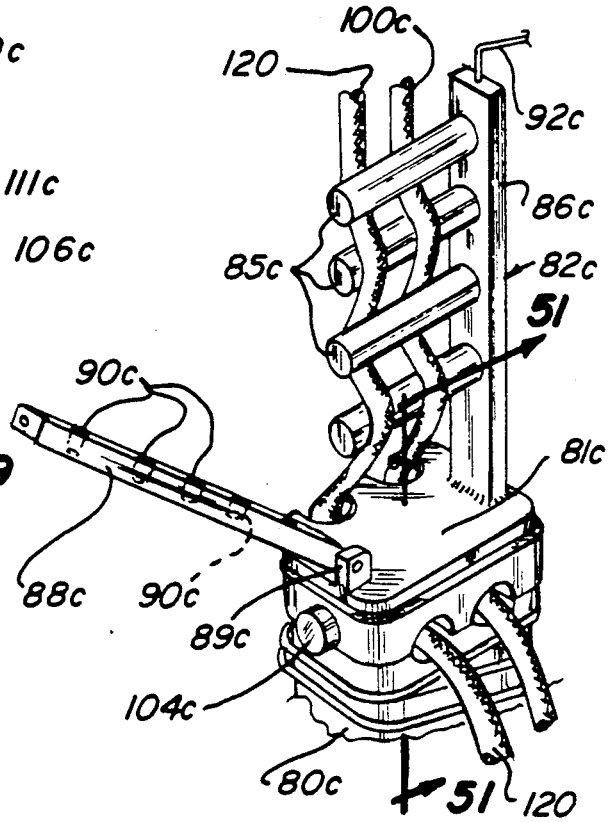
FIG. 50 is a partial perspective view of the descent controller shown in FIG. 48 but with the outer cover removed and the ladder capstans released for rope engagement.
Figure 49:
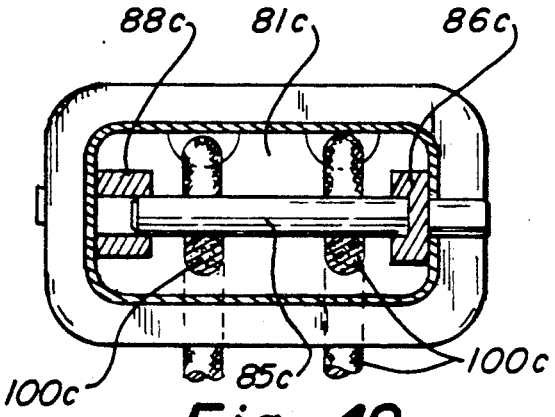
FIG. 49 is an enlarged section view taken substantially in the plane of line 49—49 on FIG. 48.
Figure 51:
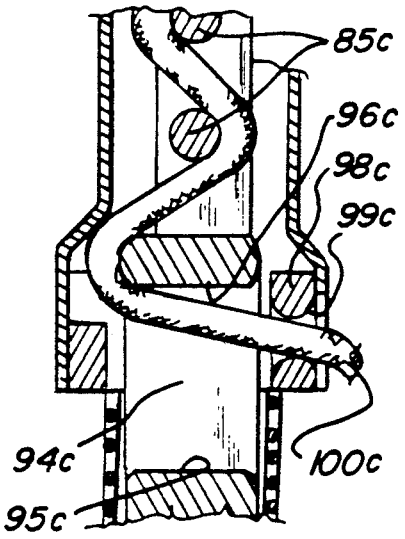
FIG. 51 is an enlarged section view taken substantially in the plane of line 51—51 on FIG. 50.

In use, a rope 100 is woven through the bars 85 of the ladder or rack capstan 82 by passing it alternately in front and back of the bars or rods 85 as shown in FIG. 47. The rope 100 is then passed through a slot 101 defined in the upper capstan support plate 81 and through the tapered aperture 94 in the capstan support body 80, and then outwardly through the control aperture 99 in the control ring 98. By moving the control ring 98 up and down on the capstan support body 80, the rope 100 may be selectively positioned in gripping engagement with the narrower end 96 of the tapered slot 94 or in the wider end 95 thereof, allowing the device to descend along the rope slowed by the frictional engagement of the rope with the ladder or rack rods 85. For ease in controlling the movement of the control ring 98 and for surrounding and protecting the ladder and entrained rope, a cylindrical housing sleeve 102 extends in surrounding relationship with the ladder and the control ring 98. The cylinder 102 is releasably secured to the control ring 98 by a detent 104 on the control ring engagable in a corresponding aperture 105 in the housing. The housing may further be provided with a roughened gripping surface 106 to facilitate use of the cylindrical housing as a handle or grip. The control ring 98 is biased to its rope locking position by a biasing spring 108 acting between the control ring and a support ring 109 securely by a retaining ring 110 on the cylindrical support body 80. The cylindrical housing 102 may be provided with a longitudinal slot 111 so that the housing may be removed from the rope when the rope is to be positioned in or removed from the ladder or rack. Similarly, appropriate entrance slots may be provided into the tapered slot 95 and the control rings aperture 99 in order to enable the rope to be inserted in or removed from these openings, as described above in connection with the modification shown in FIGS. 24–43.

A modified form of a ladder or rack descent controller is adapted for use with a second rope in order to provide a safety redundancy, as is shown in FIGS. 50–53. In describing this modification, reference numerals similar to those utilized in describing the modification shown in FIGS. 46–49 will be employed with the distinguishing suffix "c".

The double rope ladder or rack capstan descent controller, as shown in FIGS. 50–53, comprises a generally cylindrical body 80c, having a flange 81c at one end thereof supporting a ladder or rack capstan arrangement 82c. At its other end, the body 80c defines an aperture 84c for securing the device to a load or load supporting assembly, such as a harness (not shown).

The ladder or rack assembly 82c comprises a plurality of coplaner vertically arranged generally horizontal-spaced apart bars or rods 85c supported at their opposite ends by spaced parallel support panels 86c, 88c, secured and upstanding relation on the end flange 81c. One of the panels 88c is preferably hinged to the support flange 81c by an appropriate hinged structure 89c.

Each of the support panels 86c, 88c, defines an array of apertures 90c for receiving inserted ends of the capstan bars or rods 85c. A latch pin 92c engaged between the side panels 86c, 88c holds the side panels together with the rods 85c securely supported therebetween.

A pair of ropes 100c are woven through the bars or rods 85c of the ladder or rack capstan by passing them alternately in front and back of the bars or rods 85c as shown in FIG. 52. A redundant or back-up rope system is thus provided, adding an additional safety factor to the device.

For selectively gripping or releasing the pair of ropes 100c, the support body 80c includes a pair of side-by-side vertically oriented tapered slots 94c each having a lower wider end 95c and an upper narrower end 96c. The wider end 95c is of a dimension to freely pass the rope 100c while the narrower end 96c serves to grip a rope wedged therein. By selectively positioning the rope either in the wider end or the narrower end of the tapered slots 94c, the rope can be selectively released or gripped to control the descent of a supported load. For positively positioning the ropes 100c at the desired position in the tapered slots 94c, there is provided a control ring 98c slidably mounted on the support body 80c and having spaced apart radial apertures 99c extending therethrough for receiving the ropes 100c. By moving the control ring 98c upward or downward on the body 80c the ropes are guided into or out of the narrower end 96c of the tapered slot 94c in the same manner as described above.

In use, a pair of ropes 100c, 120 are woven through the bars 85c of the ladder or rack capstan and then through the tapered apertures 94c and the control ring 98c, as shown in FIG. 52. For moving the control ring up and down on the body 80c there is provided an external housing sleeve 102c which extends in surrounding relationship with the ladder or rack and the control ring 98c. The housing or cylinder 102c is releasably secured to the control ring 98c by an appropriate detent 104c on the control ring engagable in a corresponding aperture 105c in the housing. The housing is further provided with a roughened gripping surface 106c.

The control ring and housing are biased to their upper rope-gripping position by a biasing spring 108c supported on the body 80c by a support ring assembly 109c.

As described above, the housing 102c may be provided with a longitudinal slot 111c so that the housing may be removed from the ropes 100c. Similarly, appropriate access apertures are provided into the tapered slots 94c in the controller body 80c and into the control apertures 99c in the control ring 98c to allow application to the ropes intermediate their ends.

Figure 56:
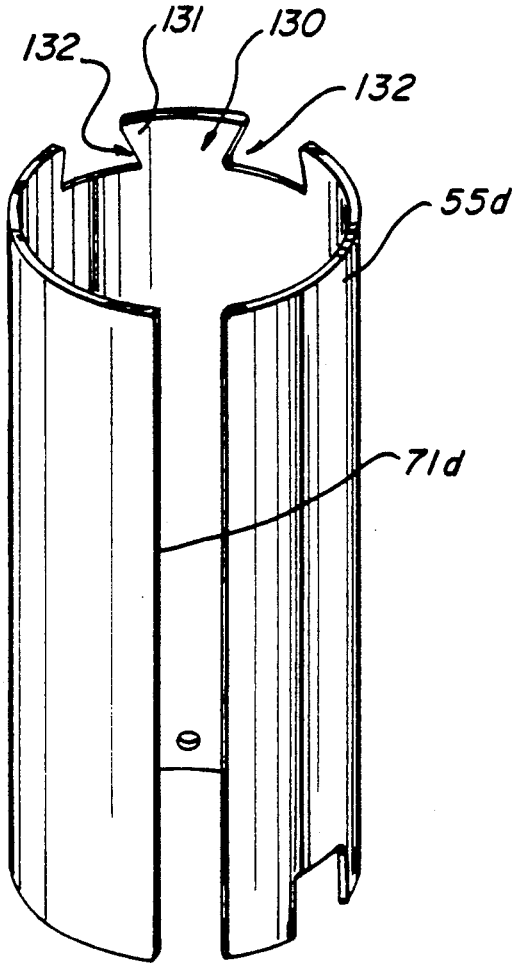
FIG. 56 is a perspective view of a modified outer gripping sleeve for the descent controller shown in FIG. 24 having a rope tie-off cleat added thereto.

The present invention finds particular but not necessarily exclusive utility in safety escape systems, as shown in FIGS. 54–56. Such an escape system includes a controller 30 such as shown in FIGS. 1–19 in association with a safety rope 32 and a supporting harness 120 such as a harness of the type disclosed and claimed in co-pending application of H. M. Varner, Ser. No. 07/554,540, filed July 18, 1990 for "EGRESS AND EVACUATION HARNES" now U.S. Pat. No. 5,070,692, issued Dec. 10, 1991. At one end, the rope 32 is provided with a loop 121 and securing device 122 to enable the rope to be secured at an elevated position. The free end of 124 of the rope 32 is housed in a container 125. The rope container 125, descent device 30, harness 120, are packaged in a kit 126 containing appropriate instructions 127.

In use, such as for a descent from a scaffold or lift truck platform, the kit 126 is opened and the loop end 121 of the rope 32 is secured to a secure fixture at the elevated location, such as a rack. The rope packet 125 is lowered and the user dons the harness 120, steps off of the platform and utilizes the descent controller 30 to descend to the ground along the free end of the rope 124.

Alternatively, as shown in FIG. 55, for lowering an unconscious person, a stretcher or a like load from an elevated position along a rope 32, a harness 120 can be secured to the loop end 121 of the rope and the descent controller 30 secured to a fixed mounting 128 by attaching the capstan thereto, utilizing the capstan bore 36 to secure the capstan 30 to the support. An operator, at the position of the fixed mounting 128, can reach the descent device 30 to actuate the controller 30 to control the descent of the load in the harness 120. The free end 124 of the rope feeds through the controller 30 as the load descends.

A further alternative use of a descent controller embodying the present invention, is for controlling the descent of work stations, such as a bosun's chair, while the rider is working on a vertical surface. The user secures the descent controller to the bosun's chair and descends to the working position. At that point the controller handle or sleeve is released, thereby stopping the descent, and enabling the user to perform a predetermined task at the vertical position at which the unit is located. When the task at that location is finished, the user can descend to a lower position and continue the work. The descent is controlled by actuating the sleeve of the descent controller to provide for a controlled descent. At the work station, it is sometimes desirable to prevent the user support from further descent or slippage along the main descent rope. To this end, the user can tie off the rope and prevent actuation of the descent controller. For additional safety, the user also conventionally employs a safety rope and rope grab (not shown), which is secured at the work station to prevent accidental descent or catch the user and prevent a fall.

In order to enable the descent rope to be tied off to lock the controller temporarily in a set position, a modified form of descent controller is provided with a rope cleat as shown in FIGS. 56–58. In describing this modification, reference characters similar to those used above will be employed with the distinguishing suffix "d." To provide a rope tie-off cleat as shown in FIG. 56, the gripping sleeve 55d is provided adjacent its upper edge with an integral cleat 130 about which the descent rope 32d may be engaged. The frictional engagement between the descent rope 32d and the cleat 130 prevents the controller 30d from descending further along the descent rope 32d. The cleat 130 is integral with the sleeve 55d and is formed by an enlarged head portion 131 defining a pair of spaced friction throats 132. By engaging the rope 32*d* in the throats 132, a frictional engagement is provided which prevents the controller from sliding along the rope. The rope may pass through the upper portion of the sleeve slot 71*d*. To release the rope from the cleat, it is only necessary to pull down on the sleeve 55*d*. The rope is engaged by the upper surface of the capstan flange 34*d*, and is pushed off of the cleat 130 thereby allowing the controller to controllably descent along the rope 32*d*.

An alternative rope tie-off is shown in FIG. 59 and simply involves forming the rope 32 into a loop 135 and utilizing the loop, tying a half hitch around the upper portion of the rope above the controller. To descend, it is only necessary to release the half hitch.

The present invention finds utility with a safety or emergency kit utilized for descending from a stacker, forklift or crane, or other piece of industrial equipment in the event of an accident or emergency. The kit is maintained in a compartment in which the user rides, such as the cab of an overhead crane. In the event of an emergency, the rope loop is hooked over a portion of the overhead guard or other stable part of the equipment. The user dons the harness and descends to a lower level, utilizing the controller to control the rate of descent. While the unit may be reusable, such safety kits are preferably adapted for a single use. This insures that the kits are properly packed and complete.

The foregoing descent controller devices provide a controllable means for a person located high above the ground or floor to descend on a rope. Applications include but are not limited to egress from overhead crane cabs, forklift or stockpicker cabs, and the buckets on high-lift utility vehicles. In addition, the device may be used for the evacuation of buildings, bridges, structures, platforms, ships, or aircraft where the descent distance is sufficient to cause injury if the user jumps without a control device. Another application is for the rescue of persons trapped in a building by fire, stranded on a ledge or a mountain, or in similar hazardous situations. Police special weapons teams and armed forces special forces personnel can use the device effectively for controlled descent from buildings, ledges, mountains, and other elevated positions.

While certain illustrative embodiments have been shown in the drawings and described above in considerable detail it should be understood that there is no intention to limit the invention to the specific forms disclosed. On the contrary the intention is to cover all modifications, alternative constructions, equivalents and uses falling within the spirit and scope of the invention as expressed in the appended claims.

We claim:

1. A descent controller for lowering a rope supported load from an elevated position to a relatively lower position, said controller including a friction cylinder of a length adapted to receive a plurality of turns of rope wrapped therearound, said cylinder having a first upper end and a second lower end, a portion of said friction cylinder defining an upwardly narrowing tapered slot diametrically therethrough adapted to receive the rope, said tapered slot defining an enlarged entryway adapted to freely admit the rope and tapering from said entryway to a relatively constricted end of a width sufficient for gripping the rope, a control ring slidably mounted on said cylinder adjacent said tapered slot and defining a radial aperture therethrough adapted to loosely receive said rope as it exits from said tapered slot, a spring biasing said ring in a direction along said friction cylinder for wedging said rope in said tapered slot, said control ring being slidable along said friction cylinder for releasing said rope from the narrow end of said tapered slot, and means on said friction cylinder for engagement with a load support whereby sliding movement of said control ring controls the descent of said supported load along said rope.

2. A descent controller as defined in claim 1 further comprising a gripping sleeve secured to said control ring for use in sliding said control ring along said friction cylinder.

3. A descent controller as defined in claim 2 wherein said gripping sleeve includes a roughened exterior surface.

4. A descent controller as defined in claim 2 wherein said gripping sleeve defines a housing enclosing said friction cylinder and the rope wrapped therearound.

5. A descent controller as defined in claim 2 wherein said gripping sleeve is releasably secured to said control ring, and further includes a longitudinally extending slot therein of a width for receiving said rope.

6. A descent controller as defined in claim 1 wherein said friction cylinder defines a radial slot opening into said tapered slot and sized to loosely receive said rope.

7. A descent controller as defined in claim 6 wherein said control ring defines an axially extending slot opening into said radial aperture and sized to loosely receive said rope whereby said rope can be released from or inserted into said aperture.

8. A descent controller as defined in claim 7 further comprising a gripping sleeve secured to said control ring for use in sliding said control ring along said friction cylinder.

9. A descent controller as defined in claim 8 wherein said gripping sleeve defines a housing enclosing said friction cylinder and the rope wrapped therearound.

10. A descent controller as defined in claim 9 wherein said gripping sleeve is releasably secured to said control ring, and further includes a longitudinally extending slot therein of a width for receiving said rope.

11. A descent controller for lowering a rope supported load from an elevated position to a relatively lower position, said controller including a friction cylinder of a length adapted to receive a plurality of turns of rope wrapped therearound, said cylinder having spaced apart first and second ends, first and second end plates attached respectively adjacent the first end and spaced from the second end of said cylinder, said end plates both having a portion thereof overhanging the cylinder and defining radial slots sized to loosely receive the rope, a portion of said friction cylinder defining means for releasably gripping said rope, means slidably mounted on said cylinder adjacent second end plate for positioning said rope with respect to said gripping means, means secured to said rope positioning means for sliding said rope positioning means along said friction cylinder to release or engage said rope with said gripping means, and means on one end of said friction cylinder for engagement with a support whereby sliding movement of said slidably mounted rope positioning means provides for a controlled descent of said rope supported load.

12. A descent controller for lowering a load along a rope from an elevated position to a relatively lower position, said controller including a friction brake adapted to receive said rope entrained thereon, a control shaft secured to said friction brake and defining means for releasably gripping control said rope, means slidably mounted on said control shaft for controllably positioning said rope with respect to said gripping means, and means on said control shaft for engagement with a load support whereby said descent controller supports a load on said rope and upon sliding movement of said sliding means provides for a controlled descent of said supported load along said rope.

13. A descent controller for lowering a load along a rope from an elevated position to a relatively lower position, said controller including a friction brake adapted to receive said rope entrained thereon, a control shaft secured to said friction brake and defining a tapered slot diametrically therethrough adapted to receive the rope, said tapered slot defining an enlarged entryway adapted to freely admit the rope and tapering from said entryway to a relatively constricted end of a width sufficient for gripping the rope, a control ring slidably mounted on said control shaft and defining a radial aperture therethrough adapted to loosely receive said rope as it exits from said tapered slot, a spring biasing said ring along said shaft in a direction for wedging said rope in said tapered slot, said control ring being slidable along said shaft against the force of said spring for releasing said rope from the narrow end of said tapered slot, and means on said shaft adjacent said tapered slot for engagement with a load support whereby said descent controller supports a load on said rope and upon sliding movement of said control ring provides for a controlled descent of said supported load along said rope.

14. A descent controller as defined in claim 13 further comprising a gripping sleeve secured to said control ring for use in sliding said control ring along said friction cylinder.

15. A descent controller as defined in claim 14 wherein said gripping sleeve defines a housing enclosing said friction brake and the rope entrained thereon.

16. A descent controller as defined in claim 14 wherein said gripping sleeve is releasably secured to said control ring, and further includes a longitudinally extending slot therein of a width for receiving said rope.

17. A descent controller as defined in claim 13 wherein said control shaft defines a radial slot opening into said tapered slot and sized to loosely receive said rope.

18. A descent controller as defined in claim 17 wherein said control ring defines an axially extending slot opening into said radial aperture and sized to loosely receive said rope whereby said rope can be released from or inserted into said aperture.

19. A descent controller as defined in claim 18 further comprising a gripping sleeve secured to said control ring for use in sliding said control ring along said control shaft.

20. A descent controller as defined in claim 19 wherein said gripping sleeve defines a housing enclosing said friction brake and the rope entrained thereon.

21. A descent controller as defined in claim 20 wherein said gripping sleeve is releasably secured to said control ring, and further includes a longitudinally extending slot therein of a width for receiving said rope.

22. A descent controller for lowering a load along a rope from an elevated position to a relatively lower position, said controller including a friction brake adapted to receive said rope entrained thereon, a control shaft secured to said friction brake and defining diametrically therethrough an upwardly narrowing tapered slot adapted to freely admit the rope and tapering from said enlarged end to a relatively constricted end of a width sufficient for gripping the rope, an annular control ring slidably mounted on said cylinder adjacent said tapered slot and defining radially therethrough an aperture adapted to loosely receive said rope as it exits from said tapered slot, a spring biasing said ring upwardly along said control shaft for wedging said rope in the narrow end of said tapered slot, a sleeve secured to said ring for use in sliding said ring along said friction cylinder against the force of said biasing spring to release said rope from the narrow end of said tapered slot, said sleeve defining a housing enclosing said friction brake and the rope entrained thereon, and means on the lower end of said shaft below said tapered slot for engagement with a load support, whereby said descent controller supports a load on said rope and upon sliding movement of said sleeve provides for a controlled descent of said supported load along said rope.

23. A descent controller for lowering a rope supported load from an elevated position to a relatively lower position, said controller being adapted to be secured at said elevated position and including a friction cylinder of a length adapted to receive a plurality of turns of said rope wrapped therearound, said cylinder having a first end and a second end, first and second end plates attached respectively adjacent the first end and spaced from the second end of said cylinder, said end plates both having a portion thereof overhanging the cylinder and defining radial slots sized to loosely receive the rope, a portion of said friction cylinder extending below said second end plate and defining diametrically therethrough a tapered slot adapted to receive the rope, said tapered slot defining an enlarged end spaced from said second end plate and adapted to freely admit the rope and tapering from said enlarged end to a relatively constricted end adjacent said second end plate and of a width sufficient for gripping the rope, an annular control ring slidably mounted on said cylinder on the opposite side of said second end plate from said first end plate and defining radially therethrough an aperture adapted to loosely receive said rope as it exits from said tapered slot, a spring biasing said ring towards said second end plate along said friction cylinder for wedging said rope in the narrow end of said tapered slot, a sleeve secured to said ring for use in sliding said ring along said friction cylinder against the force of said biasing spring to release said rope from the narrow end of said tapered slot, said sleeve defining a housing enclosing said friction cylinder and the rope wrapped therearound, and means on the second end plate end of said friction cylinder for engagement with a fixed load support at said elevated position, whereby said descent controller supports said rope and upon sliding movement of said sleeve provides for a controlled descent of said rope supported load.

24. A descent controller for lowering a load along a rope from an elevated position to a relatively lower position, said controller including a friction cylinder of a length adapted to receive a plurality of turns of rope wrapped therearound, said cylinder having an upper end and a lower end, top and bottom end plates attached respectively adjacent the upper end and spaced from the lower end of said cylinder, said end plates both having a portion thereof overhanging the cylinder and defining radial slots sized to loosely receive the rope, a portion of said friction cylinder extending below said lower end plate and defining diametrically therethrough an upwardly narrowing tapered slot adapted to receive the rope, said tapered slot defining an enlarged end adapted to freely admit the rope and tapering from said enlarged end to a relatively constricted end of a width sufficient for gripping the rope, an annual control ring slidably mounted on said cylinder below said bottom end plate and defining a radially therethrough an aperture adapted to loosely receive said rope as it exits from said tapered slot, a spring biasing said ring upwardly along said friction cylinder for wedging said rope in the narrow end of said tapered slot, a sleeve secured to said ring for use in sliding said ring along said friction cylinder against the force of said biasing spring to release said rope from the narrow end of said tapered slot, said sleeve defining a housing enclosing said friction cylinder and the rope wrapped therearound, and means on the lower end of said friction cylinder below said tapered slot for engagement with a load support, whereby said descent controller supports a load on said rope and upon sliding movement of said sleeve provides for a controlled descent of said supported load along said rope.

25. A descent controller for lowering a load along a rope from an elevated position to a relatively lower position, said controller including a friction cylinder of a length adapted to receive a plurality of turns of rope wrapped therearound, said cylinder having an upper end and a lower end, top and bottom end plates attached respectively adjacent the upper end and spaced from the lower end of said cylinder, said end plates both having a portion thereof overhanging the cylinder and defining radial slots sized to loosely receive the rope, a portion of said friction cylinder extending below said lower end plate and defining an upwardly narrowing tapered slot diametrically therethrough adapted to receive the rope, said tapered slot defining an enlarged entryway adapted to freely admit the rope and tapering from said entryway to a relatively constricted end of a width sufficient for gripping the rope, a control ring slidably mounted on said cylinder below said bottom end plate and defining a radial aperture therethrough adapted to loosely receive said rope as it exits from said tapered slot, a spring biasing said ring upwardly along said friction cylinder for wedging said rope in said tapered slot, said control ring being slidable along said friction cylinder away from said bottom end plate for releasing said rope from the narrow end of said tapered slot, and means on the lower end of said friction cylinder below said tapered slot for engagement with a load support whereby said descent controller supports a load on said rope and upon sliding movement of said control ring provides for a controlled descent of said supported load along said rope.

26. A descent controller as defined in claim 25 further comprising a gripping sleeve secured to said control ring for use in sliding said control ring along said friction cylinder.

27. A descent controller as defined in claim 26 wherein said gripping sleeve includes a roughened exterior surface.

28. A descent controller as defined in claim 26 wherein said gripping sleeve defines a housing enclosing said friction cylinder and the rope wrapped therearound.

29. A descent controller as defined in claim 26 wherein said gripping sleeve is releasably secured to said control ring, and further includes a longitudinally extending slot therein of a width for receiving said rope.

30. A descent controller as defined in claim 25 wherein said friction cylinder defines a radial slot opening into said tapered slot and sized to loosely receive said rope.

31. A descent controller as defined in claim 30 wherein said control ring defines an axially extending slot opening into said radial aperture and sized to loosely receive said rope whereby said rope can be released from or inserted into said aperture.

32. A descent controller as defined in claim 31 further comprising a gripping sleeve secured to said control ring for use in sliding said control ring along said friction cylinder.

33. A descent controller as defined in claim 32 wherein said gripping sleeve defines a housing enclosing said friction cylinder and the rope wrapped therearound.

34. A descent controller as defined in claim 33 wherein said gripping sleeve is releasably secured to said control ring, and further includes a longitudinally extending slot therein of a width for receiving said rope.

35. A descent controller for lowering a load along a rope from an elevated position to a relatively lower position, said controller including a friction cylinder of a length adapted to receive a plurality of turns of rope wrapped therearound, said cylinder having an upper end and a lower end, top and bottom end plates attached respectively adjacent the upper end and spaced from the lower end of said cylinder, said end plates both having a portion thereof overhanging the cylinder and defining radial slots sized to loosely receive the rope, a portion of said friction cylinder extending below said lower end plate and defining means for releasably gripping said rope, means slidably mounted on said cylinder below said bottom end plate for positioning said rope with respect to said gripping means, means secured to said rope positioning means for sliding said rope positioning means along said friction cylinder to release or engage said rope with said gripping means, and means on the lower end of said friction cylinder for engagement with a load support whereby said descent controller supports a load on said rope and upon sliding movement of said slidably mounted rope positioning means provides for a controlled descent of said supported load along said rope.

36. A descent controller for lowering a load along a rope from an elevated position to a relatively lower position, said controller including a friction brake adapted to receive said rope entrained therein, a control shaft secured to said friction brake and defining means for releasably gripping control said rope, means slidably mounted on said control shaft for controllably positioning said rope with respect to said gripping means, and means on said control shaft for engagement with a load support whereby said descent controller supports a load on said rope and upon sliding movement of said sliding means provides for a controlled descent of said supported load along said rope.

37. A descent controller for lowering a load along a rope from an elevated position to a relatively lower position, said controller including a friction brake adapted to receive said rope entrained thereon, a control shaft secured to said friction brake and defining an upwardly narrowing tapered slot diametrically therethrough adapted to receive the rope, said tapered slot defining an enlarged entryway adapted to freely admit the rope and tapering from said entryway to a relatively constricted end of a width sufficient for gripping the rope, a control ring slidably mounted on said control shaft and defining a radial aperture therethrough adapted to loosely receive said rope as it exits from said tapered slot, a spring biasing said ring upwardly along said shaft for wedging said rope in said tapered slot, said control ring being slidable along said shaft against the force of said spring for releasing said rope from the narrow end of said tapered slot, and means on the lower end of said shaft below said tapered slot for engagement with a load support whereby said descent controller supports a load on said rope and upon sliding movement of said control ring provides for a controlled descent of said supported load along said rope.

38. A descent controller as defined in claim 37 further comprising a gripping sleeve secured to said control ring for use in sliding said control ring along said friction cylinder.

39. A descent controller as defined in claim 38 wherein said gripping sleeve defines a housing enclosing said friction brake and the rope entrained thereon.

40. A descent controller as defined in claim 38 wherein said gripping sleeve is releasably secured to said control ring, and further includes a longitudinally extending slot therein of a width for receiving said rope.

41. A descent controller as defined in claim 37 wherein said control shaft defines a radial slot opening into said tapered slot and sized to loosely receive said rope.

42. A descent controller as defined in claim 41 wherein said control ring defines an axially extending slot opening into said radial aperture and sized to loosely receive said rope whereby said rope can be released from or inserted into said aperture.

43. A descent controller as defined in claim 42 further comprising a gripping sleeve secured to said control ring for use in sliding said control ring along said control shaft.

44. A descent controller as defined in claim 43 wherein said gripping sleeve defines a housing enclosing said friction brake and the rope entrained thereon.

45. A descent controller as defined in claim 44 wherein said gripping sleeve is releasably secured to said control ring, and further includes a longitudinally extending slot therein of a width for receiving said rope.

46. A descent controller for lowering a load along a rope from an elevated position to a relatively lower position, said controller including a friction brake adapted to receive said rope entrained thereon, a control shaft secured to said friction brake and defining diametrically therethrough an upwardly narrowing tapered slot adapted to freely admit the rope and tapering from said enlarged end to a relatively constricted end of a width sufficient for gripping the rope, an annular control ring slidably mounted on said cylinder adjacent said tapered slot and defining radially therethrough an aperture adapted to loosely receive said rope as it exits from said tapered slot, a spring biasing said ring upwardly along said control shaft for wedging said rope in the narrow end of said tapered slot, a sleeve secured to said ring for use in sliding said ring along said friction cylinder against the force of said biasing spring to release said rope from the narrow end of said tapered slot, said sleeve defining a housing enclosing said friction brake and the rope entrained thereon, and means on the lower end of said shaft below said tapered slot for engagement with a load support, whereby said descent controller supports a load on said rope and upon sliding movement of said sleeve provides for a controlled descent of said supported load along said rope.

47. In a detent for releasably securing an outer sleeve in a telescoping arrangement with an inner cylinder, said detent including a detent pin resiliently mounted on said cylinder and an aperture defined in said outer sleeve for releasable engagement with said detent pin, and means brasing said detent pin outwardly of said cylinder, wherein the improvement in said brasing means comprises a stiffly resilient spring engaged with said detent pin and basing said detent pin outwardly of said cylinder into releasable locking engagement with said sleeve aperture, said spring having a general arcual shape, an interval leg on one end of said spring, said cylinder including a peripheral groove adapted to receive said arcuator spring, said groove terminating at one end in a recess adapted to slidably receive said spring let with the opposite free end of said spring extending into said recess, said detent pin having a diametric bore therethrough adapted to receive the free end of said leaf spring, and means for securing said spring in said peripheral groove with said leg in said hole and said free end is engaged with said detent pin in said recess whereby aid detent pin is biased by said spring outwardly of said recess into releasable locking engagement with said sleeve aperture.

48. A detent as defined in claim 47 wherein said spring is a wire spring.

49. A detent as defined in claim 47 wherein said spring is a flat spring.

50. A detent as defined in claim 47 wherein said spring is a leaf spring.

51. A detent as defined in claim 47 wherein said peripheral groove tapers radially inwardly of said cylinder to provide clearance for said spring as said detent pin is pushed.

52. An emergency escape kit comprising, in combination, a safety rope, means on said rope adapted to be secured to a fixed support at an elevated position, a rope pack containing and protecting said rope, a descent controller slidably mounted on said rope, a foldable harness seat secured to said descent controller and adapted to support a user therefrom, and a housing pack for containing and protecting said rope pack, descent controller and harness.

53. A descent controller as defined in claim 1 wherein said gripping sleeve includes a belt hook.

54. A descent controller as defined in claim 1 wherein said gripping sleeve includes an integral rope tie-off cleat.

* * * * *